US008453349B2

(12) United States Patent
Auger et al.

(10) Patent No.: US 8,453,349 B2
(45) Date of Patent: Jun. 4, 2013

(54) TRACTION ELEMENTS

(75) Inventors: Perry W. Auger, Tigard, OR (US); Brian D. Baker, Portland, OR (US); Andrew Caine, Portland, OR (US); Sergio Cavaliere, Venice (IT); Daniel W. Peter, Portland, OR (US); Timothy J. Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 468 days.

(21) Appl. No.: 12/752,318

(22) Filed: Apr. 1, 2010

(65) Prior Publication Data

US 2010/0251578 A1 Oct. 7, 2010

Related U.S. Application Data

(60) Provisional application No. 61/166,191, filed on Apr. 2, 2009.

(51) Int. Cl.
*A43C 15/14* (2006.01)

(52) U.S. Cl.
USPC ..... 36/59 R; 36/61; 36/67 R

(58) Field of Classification Search
USPC ..... 36/59 R, 59 C, 67 R, 67 D, 61, 134, 36/126–129
See application file for complete search history.

(56) References Cited

U.S. PATENT DOCUMENTS

| | | | | |
|---|---|---|---|---|
| D15,185 | S | 8/1884 | Brooks | |
| 303,287 | A | 8/1884 | Hunn | |
| 830,324 | A | 9/1906 | Hunt | |
| 1,087,212 | A | 2/1914 | Caldwell | |
| 1,355,827 | A | 10/1920 | Finneran | |
| 1,361,078 | A | 12/1920 | Lynn | |
| 1,528,782 | A | 11/1924 | Perry | |
| 1,736,576 | A | 11/1929 | Cable | |
| D81,917 | S | 9/1930 | Burchfield | |
| 1,876,195 | A | 9/1932 | Youmans | |
| 2,087,945 | A | 7/1937 | Butler | |
| 2,095,095 | A * | 10/1937 | Howard | 36/59 R |
| 2,185,397 | A | 1/1940 | Birchfield | |
| 2,222,650 | A | 11/1940 | Brady | |
| 2,258,734 | A | 10/1941 | Brady | |
| D171,130 | S | 12/1953 | Gruner | |
| 3,043,026 | A | 7/1962 | Semon | |
| 3,063,171 | A * | 11/1962 | Hollander | 36/59 R |

(Continued)

FOREIGN PATENT DOCUMENTS

| | | |
|---|---|---|
| CA | 2526727 | 5/2007 |
| DE | 930798 | 7/1955 |

(Continued)

OTHER PUBLICATIONS

International Search Report and Written Opinion mailed Jun. 13, 2012 in International Application No. PCT/US2012/021663.

(Continued)

*Primary Examiner* — Marie Patterson
(74) *Attorney, Agent, or Firm* — Banner & Witcoff, Ltd.

(57) ABSTRACT

Traction elements for an article of footwear can include stabilizer elements. An extendable traction element for an article of footwear can include an elongatable extender attached to another portion of a sole structure. An actuator can rest within the extender and cause elongation of the extender in response to a force from the foot of a wearer.

36 Claims, 21 Drawing Sheets

U.S. PATENT DOCUMENTS

| | | | | |
|---|---|---|---|---|
| D201,865 | S | | 8/1965 | Bingham, Jr. et al. |
| 3,328,901 | A | | 7/1967 | Strickland |
| 3,341,952 | A | | 9/1967 | Dassler |
| 3,352,034 | A | * | 11/1967 | Braun ..... 36/67 D |
| D213,416 | S | | 3/1969 | Dittmar et al. |
| D219,503 | S | | 12/1970 | Vietas |
| 3,597,863 | A | | 8/1971 | Austin et al. |
| 3,619,916 | A | | 11/1971 | Neri |
| 3,631,614 | A | | 1/1972 | Rice |
| 3,656,245 | A | | 4/1972 | Wilson |
| 3,775,874 | A | | 12/1973 | Bonneville |
| 3,951,407 | A | | 4/1976 | Calacurcio |
| 4,096,649 | A | | 6/1978 | Saurwein |
| 4,107,858 | A | | 8/1978 | Bowerman et al. |
| 4,146,979 | A | | 4/1979 | Fabbrie |
| D255,957 | S | | 7/1980 | Pasquier |
| 4,245,406 | A | | 1/1981 | Landay et al. |
| 4,271,608 | A | | 6/1981 | Tomuro |
| 4,315,374 | A | | 2/1982 | Sneeringer |
| 4,335,530 | A | | 6/1982 | Stubblefield |
| 4,347,674 | A | | 9/1982 | George |
| 4,375,728 | A | | 3/1983 | Dassler |
| 4,375,729 | A | | 3/1983 | Buchanen, III |
| 4,392,312 | A | | 7/1983 | Crowley et al. |
| D271,159 | S | | 11/1983 | Muller-Feigelstock |
| D272,200 | S | | 1/1984 | Autry et al. |
| D272,772 | S | | 2/1984 | Kohno |
| 4,454,662 | A | | 6/1984 | Stubblefield |
| 4,466,205 | A | | 8/1984 | Corbari |
| D278,759 | S | | 5/1985 | Norton et al. |
| 4,574,498 | A | | 3/1986 | Norton et al. |
| 4,586,274 | A | | 5/1986 | Blair |
| D287,662 | S | | 1/1987 | Tonkel |
| 4,633,600 | A | | 1/1987 | Dassler et al. |
| 4,667,425 | A | * | 5/1987 | Effler et al. ..... 36/126 |
| 4,674,200 | A | | 6/1987 | Sing |
| 4,689,901 | A | | 9/1987 | Ihlenburg |
| 4,698,923 | A | * | 10/1987 | Arff ..... 36/128 |
| 4,715,133 | A | | 12/1987 | Hartjes et al. |
| D294,655 | S | | 3/1988 | Heyes |
| D295,231 | S | | 4/1988 | Heyes |
| 4,833,796 | A | | 5/1989 | Flemming |
| 4,858,343 | A | | 8/1989 | Flemming |
| 4,873,774 | A | | 10/1989 | Lafever |
| 5,025,573 | A | | 6/1991 | Giese et al. |
| 5,174,049 | A | | 12/1992 | Flemming |
| 5,201,126 | A | | 4/1993 | Tanel |
| 5,221,379 | A | | 6/1993 | Nicholas |
| D339,459 | S | | 9/1993 | Yoshikawa et al. |
| 5,289,647 | A | | 3/1994 | Mercer |
| 5,299,369 | A | | 4/1994 | Goldman |
| 5,335,429 | A | | 8/1994 | Hansen |
| 5,351,422 | A | | 10/1994 | Fitzgerald |
| 5,367,791 | A | | 11/1994 | Gross et al. |
| 5,384,973 | A | | 1/1995 | Lyden |
| 5,406,723 | A | | 4/1995 | Okajima |
| 5,410,823 | A | | 5/1995 | Iyoob |
| 5,452,526 | A | | 9/1995 | Collins |
| 5,461,801 | A | | 10/1995 | Anderton |
| 5,473,827 | A | | 12/1995 | Barre et al. |
| D368,156 | S | | 3/1996 | Longbottom et al. |
| D368,360 | S | | 4/1996 | Wolfe |
| D369,672 | S | | 5/1996 | Tanaka et al. |
| 5,513,451 | A | | 5/1996 | Kataoka et al. |
| 5,524,364 | A | | 6/1996 | Cole et al. |
| 5,526,589 | A | | 6/1996 | Jordan |
| 5,555,650 | A | | 9/1996 | Longbottom et al. |
| 5,572,807 | A | | 11/1996 | Kelly et al. |
| 5,617,653 | A | | 4/1997 | Walker et al. |
| 5,634,283 | A | | 6/1997 | Kastner |
| 5,678,328 | A | | 10/1997 | Schmidt et al. |
| D387,892 | S | | 12/1997 | Briant |
| D389,298 | S | | 1/1998 | Briant |
| 5,709,954 | A | | 1/1998 | Lyden et al. |
| D394,943 | S | | 6/1998 | Campbell et al. |
| 5,761,832 | A | | 6/1998 | George |
| 5,775,010 | A | | 7/1998 | Kaneko |
| 5,806,209 | A | | 9/1998 | Crowley et al. |
| 5,815,951 | A | | 10/1998 | Jordan |
| 5,832,636 | A | | 11/1998 | Lyden et al. |
| 5,887,371 | A | | 3/1999 | Curley, Jr. |
| 5,946,828 | A | | 9/1999 | Jordan et al. |
| 5,956,871 | A | | 9/1999 | Korsen |
| D415,340 | S | | 10/1999 | McMullin |
| 5,979,083 | A | | 11/1999 | Robinson et al. |
| 5,983,529 | A | | 11/1999 | Serna |
| 5,987,783 | A | | 11/1999 | Allen et al. |
| 6,016,613 | A | | 1/2000 | Campbell et al. |
| D421,833 | S | | 3/2000 | Fallon |
| 6,035,559 | A | | 3/2000 | Freed et al. |
| 6,079,127 | A | | 6/2000 | Nishimura et al. |
| D427,754 | S | | 7/2000 | Portaud |
| 6,101,746 | A | | 8/2000 | Evans |
| 6,112,433 | A | | 9/2000 | Greiner |
| 6,125,556 | A | | 10/2000 | Peckler et al. |
| 6,145,221 | A | | 11/2000 | Hockerson |
| 6,161,315 | A | | 12/2000 | Dalton |
| D437,108 | S | | 2/2001 | Peabody |
| D437,989 | S | | 2/2001 | Cass |
| 6,199,303 | B1 | | 3/2001 | Luthi et al. |
| 6,231,946 | B1 | | 5/2001 | Brown, Jr. et al. |
| 6,256,907 | B1 | | 7/2001 | Jordan et al. |
| 6,357,146 | B1 | * | 3/2002 | Wordsworth et al. ..... 36/128 |
| 6,389,714 | B1 | | 5/2002 | Mack |
| D461,297 | S | | 8/2002 | Lancon |
| 6,481,122 | B2 | | 11/2002 | Brahler |
| D468,517 | S | | 1/2003 | Recchi et al. |
| 6,550,160 | B2 | | 4/2003 | Miller, II |
| D477,905 | S | | 8/2003 | Adams et al. |
| D478,714 | S | | 8/2003 | Recchi |
| 6,647,647 | B2 | | 11/2003 | Auger et al. |
| 6,675,505 | B2 | | 1/2004 | Terashima |
| 6,698,110 | B1 | | 3/2004 | Robbins |
| 6,708,427 | B2 | | 3/2004 | Sussmann et al. |
| 6,725,574 | B2 | | 4/2004 | Hokkirigawa et al. |
| 6,739,075 | B2 | | 5/2004 | Sizemore |
| 6,754,984 | B2 | | 6/2004 | Schaudt et al. |
| D495,122 | S | | 8/2004 | McMullin |
| 6,834,446 | B2 | * | 12/2004 | McMullin ..... 36/134 |
| 6,892,479 | B2 | | 5/2005 | Auger et al. |
| 6,904,707 | B2 | | 6/2005 | McMullin |
| 6,915,595 | B2 | | 7/2005 | Kastner |
| 6,915,596 | B2 | | 7/2005 | Grove et al. |
| 6,935,055 | B2 | | 8/2005 | Oorei |
| 6,941,684 | B2 | | 9/2005 | Auger et al. |
| 6,954,998 | B1 | | 10/2005 | Lussier |
| 6,968,637 | B1 | | 11/2005 | Johnson |
| 6,973,745 | B2 | | 12/2005 | Mills et al. |
| 6,973,746 | B2 | | 12/2005 | Auger et al. |
| 7,007,410 | B2 | | 3/2006 | Auger et al. |
| D525,416 | S | | 7/2006 | Auger et al. |
| 7,143,530 | B2 | | 12/2006 | Hudson et al. |
| 7,181,868 | B2 | | 2/2007 | Auger et al. |
| 7,194,826 | B2 | | 3/2007 | Ungari |
| 7,204,044 | B2 | | 4/2007 | Hoffer et al. |
| 7,234,250 | B2 | | 6/2007 | Fogarty et al. |
| 7,254,909 | B2 | | 8/2007 | Ungari |
| 7,269,916 | B2 | | 9/2007 | Biancucci et al. |
| 7,287,343 | B2 | | 10/2007 | Healy |
| 7,370,439 | B1 | | 5/2008 | Myers |
| D571,092 | S | | 6/2008 | Norton |
| D571,542 | S | | 6/2008 | Wilken |
| 7,386,948 | B2 | | 6/2008 | Sink |
| D573,779 | S | | 7/2008 | Stauffer |
| 7,401,418 | B2 | | 7/2008 | Wyszynski et al. |
| D575,041 | S | | 8/2008 | Wilken |
| 7,406,781 | B2 | | 8/2008 | Scholz |
| 7,409,783 | B2 | | 8/2008 | Chang |
| D578,280 | S | | 10/2008 | Wilken |
| 7,430,819 | B2 | | 10/2008 | Auger et al. |
| 7,441,350 | B2 | | 10/2008 | Auger et al. |
| 7,490,418 | B2 | | 2/2009 | Obeydani |
| 7,536,810 | B2 | | 5/2009 | Jau et al. |
| 7,559,160 | B2 | * | 7/2009 | Kelly ..... 36/127 |
| 7,584,554 | B2 | | 9/2009 | Fogarty et al. |
| 7,650,707 | B2 | | 1/2010 | Campbell et al. |
| 7,654,013 | B2 | * | 2/2010 | Savoie et al. ..... 36/67 D |

| | | | | |
|---|---|---|---|---|
| 7,654,014 | B1 | 2/2010 | Moore et al. | |
| 7,665,229 | B2 | 2/2010 | Kilgore et al. | |
| 7,673,400 | B2 | 3/2010 | Brown et al. | |
| 7,685,741 | B2 | 3/2010 | Friedman | |
| 7,685,745 | B2 | 3/2010 | Kuhtz et al. | |
| 7,707,748 | B2 | 5/2010 | Campbell | |
| 7,762,009 | B2 | 7/2010 | Gerber | |
| 7,784,196 | B1 | 8/2010 | Christensen et al. | |
| 7,866,064 | B2 | 1/2011 | Gerber | |
| D632,466 | S | 2/2011 | Kasprzak | |
| 8,079,160 | B2 * | 12/2011 | Baucom et al. | 36/61 |
| 8,122,617 | B1 | 2/2012 | Dixon et al. | |
| 8,256,145 | B2 * | 9/2012 | Baucom et al. | 36/61 |
| 2002/0017036 | A1 | 2/2002 | Berger et al. | |
| 2002/0078603 | A1 * | 6/2002 | Schmitt, Jr. | 36/134 |
| 2002/0100190 | A1 * | 8/2002 | Pellerin | 36/126 |
| 2003/0033731 | A1 | 2/2003 | Sizemore | |
| 2003/0188458 | A1 * | 10/2003 | Kelly | 36/128 |
| 2004/0035024 | A1 | 2/2004 | Kao | |
| 2004/0187356 | A1 | 9/2004 | Patton | |
| 2004/0250451 | A1 | 12/2004 | McMullin | |
| 2005/0016029 | A1 | 1/2005 | Auger et al. | |
| 2005/0072026 | A1 | 4/2005 | Sink | |
| 2005/0097783 | A1 | 5/2005 | Mills et al. | |
| 2005/0120593 | A1 | 6/2005 | Mason | |
| 2005/0217149 | A1 | 10/2005 | Ho | |
| 2005/0257405 | A1 | 11/2005 | Kilgore | |
| 2005/0268490 | A1 | 12/2005 | Foxen | |
| 2006/0016101 | A1 | 1/2006 | Ungari | |
| 2006/0021254 | A1 | 2/2006 | Jones | |
| 2006/0021255 | A1 | 2/2006 | Auger et al. | |
| 2006/0042124 | A1 | 3/2006 | Mills et al. | |
| 2006/0130372 | A1 | 6/2006 | Auger et al. | |
| 2006/0242863 | A1 | 11/2006 | Patmore | |
| 2007/0039209 | A1 | 2/2007 | White et al. | |
| 2007/0199211 | A1 | 8/2007 | Campbell | |
| 2007/0199213 | A1 | 8/2007 | Campbell et al. | |
| 2007/0261271 | A1 | 11/2007 | Krouse | |
| 2007/0266597 | A1 * | 11/2007 | Jones | 36/59 C |
| 2008/0010863 | A1 | 1/2008 | Auger et al. | |
| 2008/0066348 | A1 | 3/2008 | O'Brien et al. | |
| 2008/0098624 | A1 | 5/2008 | Goldman | |
| 2008/0196276 | A1 | 8/2008 | McMullin | |
| 2008/0216352 | A1 | 9/2008 | Baucom et al. | |
| 2009/0019732 | A1 | 1/2009 | Sussmann | |
| 2009/0056169 | A1 | 3/2009 | Robinson, Jr. et al. | |
| 2009/0056172 | A1 | 3/2009 | Cho | |
| 2009/0100716 | A1 | 4/2009 | Gerber | |
| 2009/0100718 | A1 | 4/2009 | Gerber | |
| 2009/0113758 | A1 | 5/2009 | Nishiwaki et al. | |
| 2009/0126230 | A1 | 5/2009 | McDonald et al. | |
| 2009/0223088 | A1 | 9/2009 | Krikorian et al. | |
| 2009/0241370 | A1 | 10/2009 | Kimura | |
| 2009/0241377 | A1 | 10/2009 | Kita et al. | |
| 2009/0272008 | A1 | 11/2009 | Nomi et al. | |
| 2009/0293315 | A1 | 12/2009 | Auger et al. | |
| 2009/0307933 | A1 | 12/2009 | Leach | |
| 2010/0050471 | A1 | 3/2010 | Kim | |
| 2010/0077635 | A1 | 4/2010 | Baucom et al. | |
| 2010/0083541 | A1 | 4/2010 | Baucom et al. | |
| 2010/0126044 | A1 | 5/2010 | Davis | |
| 2010/0199523 | A1 | 8/2010 | Mayden et al. | |
| 2010/0212190 | A1 * | 8/2010 | Schmid | 36/127 |
| 2010/0229427 | A1 | 9/2010 | Campbell et al. | |
| 2010/0313447 | A1 | 12/2010 | Becker et al. | |
| 2011/0047830 | A1 | 3/2011 | Francello et al. | |
| 2011/0078927 | A1 * | 4/2011 | Baker | 36/134 |
| 2011/0088287 | A1 | 4/2011 | Auger et al. | |
| 2011/0126426 | A1 * | 6/2011 | Mark | 36/61 |
| 2011/0167676 | A1 | 7/2011 | Benz et al. | |
| 2011/0197478 | A1 | 8/2011 | Baker | |
| 2011/0203136 | A1 | 8/2011 | Auger et al. | |
| 2012/0180343 | A1 | 7/2012 | Auger et al. | |

FOREIGN PATENT DOCUMENTS

| | | |
|---|---|---|
| DE | 3046811 | 7/1982 |
| DE | 3135347 | 3/1983 |
| DE | 3245182 | 5/1983 |
| DE | 3600525 | 10/1987 |
| DE | 3644812 | 6/1988 |
| DE | 3706069 | 9/1988 |
| DE | 4417563 | 11/1995 |
| DE | 19817579 | 10/1999 |
| EP | 115663 | 8/1984 |
| EP | 0115663 | 8/1984 |
| EP | 123550 | 10/1984 |
| EP | 0223700 | 5/1987 |
| EP | 340053 | 11/1989 |
| EP | 0723745 | 7/1996 |
| EP | 1714571 | 10/2006 |
| EP | 1839511 | 10/2007 |
| EP | 2057913 | 5/2009 |
| FR | 2567004 | 1/1986 |
| FR | 2818876 | 7/2002 |
| GB | 2113971 | 8/1983 |
| GB | 2377616 | 1/2003 |
| GB | 2425706 | 11/2006 |
| JP | 10000105 | 1/1998 |
| JP | 10066605 | 3/1998 |
| JP | 2002272506 | 9/2002 |
| JP | 2002306207 | 10/2002 |
| JP | 2005185303 | 7/2005 |
| JP | 2005304653 | 11/2005 |
| JP | 2008212532 | 9/2008 |
| TW | 540323 U | 7/2003 |
| TW | M267886 U | 6/2005 |
| WO | 0053047 | 9/2000 |
| WO | 03045182 | 6/2003 |
| WO | 03071893 | 9/2003 |
| WO | 2006103619 | 10/2006 |
| WO | 2008069751 | 6/2008 |
| WO | 2008128712 | 10/2008 |
| WO | 2009110822 | 9/2009 |
| WO | 2010036988 | 4/2010 |
| WO | 2010057207 | 5/2010 |

OTHER PUBLICATIONS

Office Action mailed Jun. 13, 2012 in U.S. Appl. No. 12/582,252.

International Search Report and Written Opinion of PCT/US2010/029640 dated May 17, 2010.

International Search Report and Written Opinion for PCT/US2009/058522 dated Feb. 17, 2010.

Partial Search Report for PTC/US2009/058522 dated Mar. 4, 2010.

International Search Report and Written Opinion for PCT/US2011/022841 dated Apr. 15, 2011.

International Search Report and Written Opinion for PCT/US2011/022848 dated Jun. 20, 2011.

Aug. 12, 2010, Icebug Web Page (date based on information from Internet Archive).

Dec. 23, 2008, Icebug Web Page (date based on information from Internet Archive).

International Search Report and Written Opinion for PCT/US2011/045356 dated Dec. 16, 2011.

International Search Report for PCT/US2010/050637 dated Jan. 14, 2011.

* cited by examiner

TRACTION ELEMENTS

CROSS-REFERENCE TO RELATED APPLICATIONS

This application claims priority to Provisional U.S. Patent Application Ser. No. 61/166,191, filed Apr. 2, 2009, and titled "Traction Elements," which application in its entirety is incorporated by reference herein. With regard to certain subject matter common to said provisional application and this application, various changes herein to the written description and drawings are merely intended to enhance readability, eliminate duplication, correct obvious errors, and/or to explicitly describe features that a person of ordinary skill in the art would have implicitly understood to be present based on reading said provisional application.

FIELD

Aspects of various embodiments relate generally to traction elements for articles of manufacture and articles of wear such as footwear, apparel, and athletic or protective gear. In more specific examples, aspects of some embodiments relate to stabilizers for traction elements for articles of footwear. In other examples, aspects of some embodiments relate to retractable and extendable traction elements for articles of footwear.

BACKGROUND

Many articles of manufacture and articles of wear benefit from traction elements. Such articles usually come into contact with a surface, such as the ground, and may be prone to slipping, instability, and other insecure contact with the surface. Traction elements provide increased friction and grip between the item and the surface that the item contacts. Traction elements usually are attached to the ground contacting surface of the article. Such traction elements are typically designed to provide additional traction in connection with a specific type of action that occurs when the article contacts the surface or ground. For example, athletic footwear may have cleats of particular sizes and shapes that are designed to provide the wearer with traction during a particular action. These cleats are often designed to provide additional traction or to prevent slipping or grip problems for a single type of action or movement. Such cleats may not provide traction for multiple types of actions and movements. Further, they may not be capable of adapting to the various actions and motions of a wearer during dynamic use of the article of footwear.

Some articles may have interchangeable traction elements that accommodate a variety of types of actions and movements. Replacing traction elements can be inefficient and time consuming. For example, an athlete may want articles of footwear that provide traction both for running and for pivoting. Typically, traction elements are designed for only one of those actions. The athlete must choose which type of traction is most important and possibly forego having traction elements that provide traction in the other type of action. Many users would appreciate if a single traction element would be able to provide traction in more than one type of action or motion and/or adapt to the dynamic conditions of various motions.

Further, most cleats are not able to adapt to various conditions. Cleats are oftentimes designed for contact with a hard surface or a soft surface, but not both types of surfaces. Cleats designed for soft surfaces tend to have a greater height relative to cleats designed for harder surfaces. Cleats for softer surfaces need to extend into the ground a greater distance to ensure stable and secure contact with the surface. Some surfaces are not uniform in hardness. Users may wish to transition from a soft surface to a hard surface quickly. Users would benefit from a cleat that is able to quickly transform its traction capabilities to conform to various types of surfaces.

Therefore, while some traction elements are currently available, there is room for improvement in this art. For example, an article of wear having traction elements with selective additional stability would be a desirable advancement in the art. Additionally, traction elements capable of providing traction under a variety of conditions and in many types of motions would also be welcomed in the art. Still further, an article having traction elements that are selectively retractable and able to adapt their characteristics to various types of surfaces would be a desirable advancement in the art.

SUMMARY

The following presents a general summary of some embodiments. This summary is not an extensive overview of the invention. It is not intended to identify key or critical elements of the invention and/or to delineate the scope of the invention. The following summary merely presents some concepts of certain embodiments in a general form as a prelude to the more detailed description provided below.

Aspects of some embodiments relate to traction elements for articles of manufacture and articles of wear. In at least some embodiments, a traction element may comprise: (1) a main body having an attached surface and an opposing free end surface, wherein the attached surface and the free end surface may be connected by a side wall; and (2) a stabilizing element having an attached end, a free end opposite the attached end, and a center portion positioned between the attached end and the free end. The attached end of the stabilizing element may be attached to the main body so that the stabilizing element is configured to extend in a direction away from the side wall of the main body. The stabilizing element may be an outrigger structure. In yet other embodiments, a sole structure may comprise a base member and a plurality of said traction elements attached to the base member. In still other embodiments, an article of footwear may comprise an upper and said sole structure engaged with the upper.

Additional embodiments include a method of manufacturing a traction element, and may comprise the steps of: (1) providing a base member; (2) attaching a traction element to the base member, the traction element defining an attached surface that is configured to be attached to the base member, a free end surface opposite the attached surface, and a side wall that interconnects the attached surface and the free end surface; and (3) attaching an outrigger structure to the traction element so that the free end is positioned to extend away from the side wall of the traction element.

Still other embodiments relate to extendable traction elements comprising an actuator and an extender. The extender may be engaged with the actuator and stretchable from a first length to a second length in response to a force on the actuator, thereby increasing an axial length of the extender and of a traction element of which that extender is a part. In yet other embodiments, an article of footwear may comprise an upper, a sole structure attached to the upper, and at least one extendable traction element secured to the sole structure.

Additional embodiments include a method of manufacturing a traction element that may comprise the steps of: (1) injecting a first shot into a first mold, wherein the first shot includes a first material for forming an extender; (2) injecting a second shot into the first mold, wherein the second shot includes a second material for forming a stud base and a tip, wherein the first shot and the second shot form a first mold element; (3) removing the first mold element from the first mold; (4) positioning the first mold element into a second mold; and (5) injecting a third shot into the second mold, wherein the third shot includes a third material for forming a plate inlay. In other embodiments, a stud tip is first formed in a stand-alone mold. The molded stud tip is then placed into a second mold. A stud base is then molded into the second mold. After forming the stud base, an extender is molded into the second mold so as to connect the stud tip and the stud base.

In still other embodiments, a sole structure for an article of footwear may comprise: (1) an insole; and (2) a first actuator attached to the insole. The insole may be a sock liner. The insole may be selectively removable from the sole structure or may be permanently attached to the sole structure. The first actuator may be selectively removable from the insole. A plurality of actuators may be engaged with the insole and may be positioned in any desired configuration.

In still other embodiments, a sole structure may comprise a base member and an extendable traction element extending from the base member.

BRIEF DESCRIPTION OF THE DRAWINGS

A more complete understanding of various embodiments and certain advantages thereof may be acquired by referring to the following description along with the accompanying drawings, in which like reference numbers indicate like features, and wherein.

Figure 1:
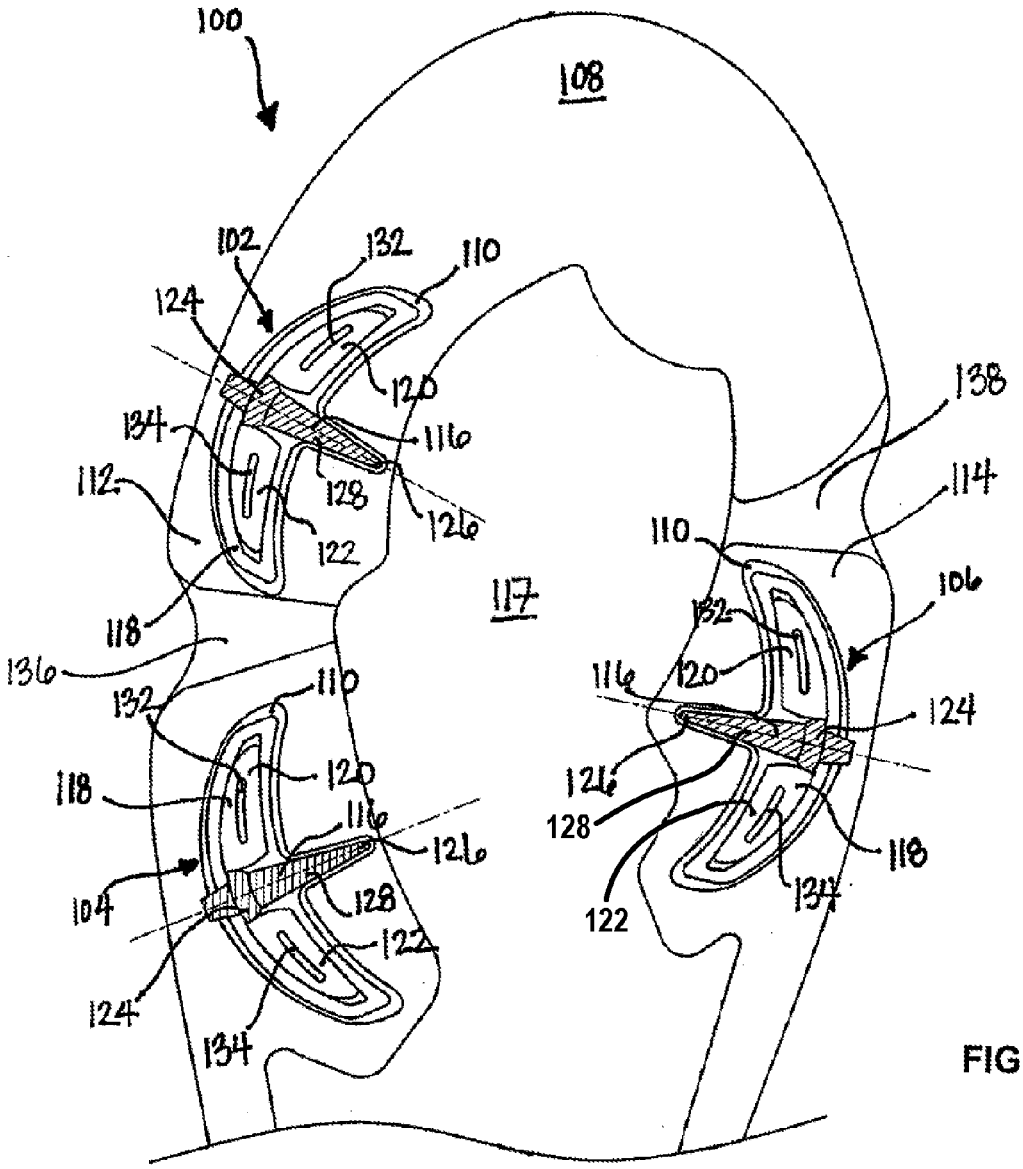
FIG. 1 is a bottom plan view of a portion of a sole structure of an article of footwear having a plurality of traction elements each with a stabilizing element.

The reader is advised that the attached drawings are not necessarily drawn to scale.

DETAILED DESCRIPTION

In the following description of various example embodiments, reference is made to the accompanying drawings, which form a part hereof, and in which are shown by way of illustration various example devices, systems, and environments in which some aspects of the invention may be practiced. It is to be understood that other specific arrangements of parts, example devices, systems, and environments may be utilized and structural and functional modifications may be made without departing from the scope of the present invention.

In general, as described above, some embodiments relate to traction elements for articles of manufacture and articles of wear, such as articles of footwear. Generally, articles of footwear comprise an upper attached to a sole structure. The sole structure may extend along the length of the article of footwear and may comprise an outsole that may form the ground contacting surface of the article of footwear. The outsole may include a base plate. Traction elements may be attached to and form portions of the outsole. Traction elements may be formed of a unitary construction with the sole structure or may be attached to the sole structure in any suitable fashion. The traction elements may be permanently attached to or selectively detachable from the sole structure.

An article of footwear may comprise a forefoot region, a midfoot region, and a heel region. This description of these footwear regions is for exemplary purposes only and is not used to delineate an exact portion of an article of footwear. One or more traction elements may be positioned in any region or a combination of regions of the sole structure of an article of footwear. For example, a plurality of traction elements may be positioned in the heel region and the forefoot region of the sole structure of an article of footwear.

Traction elements may cause friction between a sole structure and the ground or surface that it contacts to provide support and stability to the wearer of an article of footwear during various movements. For example, a plurality of traction elements may be positioned in the forefoot region of the sole structure of an article of footwear to provide support and stability when the wearer plants his or her forefoot into the ground, such as during a pivoting or turning motion. In some examples, these traction elements may be positioned along the medial and lateral edges of the forefoot region. The traction elements may be positioned to extend beneath the first and/or the fifth metatarsals of the wearer's foot or beneath the first and/or the fifth metatarsophalangeal joint of the wearer's foot. The traction elements may be positioned in any suitable configuration on the sole structure and in any region of the sole structure.

Traction elements may be various sizes and shapes. For example, traction elements may be conical, rectangular, pyramid-shaped, polygonal, or other suitable shapes. In one example, an article of footwear may have a plurality of traction elements and the traction elements may all be a uniform shape. In another example, the plurality of traction elements may be various shapes. Traction elements may be solid or may have a hollow interior and may be of any size. In one example configuration where a plurality of traction elements are attached to the sole structure, each of the traction elements may be the same size or they may be of varying sizes. Some example traction elements may be tapered as they extend away from the surface of a sole structure. The tip of a traction element may be a point, a flat surface, or any other suitable configuration. The tip may be beveled, curved, or any other suitable shape.

The surface of traction elements may have any texture or pattern. In some embodiments, the surface of a traction element is smooth. In other embodiments, the surface of a traction element may be textured to cause friction with the surface with which the traction element comes into contact. For example, a traction element may have a surface with various ribs or portions that are cut out. In other examples, a pin, spike, or other protrusion may extend from the surface of a traction element to cause additional friction when the traction element is in contact with a surface. Any friction-creating elements may be attached to a traction element in any suitable manner.

Traction elements may be attached to a midsole or to another part of a sole structure, or to any other portion of an article of footwear. Traction elements may be detachable from an article of footwear. Some example articles of footwear have traction elements that are replaceable via a mechanical connector, such as a thread and a screw combination. Traction elements and a sole structure or a portion thereof may be integrally formed. Traction elements may be attached to articles of footwear in any suitable manner and may be formed with any portion of the articles of footwear. Traction elements may be positioned in any suitable configuration within the sole structure and may be configured to engage with the ground in any desired manner.

Traction elements may comprise a main body having an attached surface and an opposing free end surface. The attached surface may be attached to the sole structure of articles of footwear. The free end may form a portion of the ground-contact surface of the traction element. A side wall may connect the attached surface and the free end. The main body may be any shape or size. In examples where there are multiple traction elements, each of the main bodies may be a different shape and/or size or the same shape and/or size. The main body may be tapered as it extends away from the surface of the sole structure, i.e., the main body is tapered from the attached surface toward the free end surface. The side wall of the main body may be any suitable shape or texture. For example, the side wall may be a curved surface or may have one or more flat surfaces or any combination thereof.

A traction element may have a stabilizing element that may have an attached end, a free end opposite the attached end, and a center portion positioned between the attached end and the free end. The stabilizing element and the main body may be integrally formed. The stabilizing element may be attached to the main body so that the stabilizing element may be configured to extend in a direction away from the side wall of the main body. The stabilizing element may extend in any direction away from the side wall. The surface of the stabilizing element may be curved or flat in any portion of the stabilizing element. For example, the stabilizing element may have a curved surface, one or more flat surfaces, or any combination thereof.

As indicated above, a traction element may be any desired size; any suitably sized main body and stabilizing element may be used.

In some example configurations, a traction element may have a plurality of stabilizing elements. For example, a traction element may have a main body and two stabilizing elements attached to the main body. The first stabilizing element may be attached at a first attachment point and the second stabilizing element may be attached at a second attachment point. In some example configurations, the first attachment point and the second attachment point may be the same position on the main body. In other example configurations, the first attachment point and the second attachment point may be different positions on the main body. The attachment points may position the stabilizing elements to extend in opposing directions, in directions that form an angle between the stabilizing elements (e.g., an obtuse angle, an acute angle, or a right angle), or in parallel directions.

In the example traction elements described above, the stabilizing element may be an outrigger structure. The outrigger structure may have an attached end, a free end, and a center portion connecting them. The outrigger structure may extend beyond the main body in any suitable direction to provide the main body with additional stability, support, and traction. The outrigger structures may extend away from the main body at any angle (i.e., acute, obtuse, or right).

The traction elements described above may be incorporated into the sole structure of an article of footwear. A sole structure may comprise a base member and a plurality of traction elements attached to the base member where each of the traction elements may comprise a main body and an outrigger structure attached to the main body. The sole structure may extend through any portion of an article of footwear. For example, the sole structure may extend through a forefoot region of the article of footwear. In such a configuration, the traction elements may be positioned within the forefoot region and the outrigger structures may be positioned to extend toward a center of the forefoot region of the sole structure. The traction elements may be configured so that the outrigger structures may be positioned to extend in any suitable direction.

The plurality of traction elements on the sole structure described above may be positioned in any suitable configuration. For example, a first traction element of the plurality of traction elements may be positioned along the medial edge of the forefoot region of the sole structure so that it extends approximately beneath the wearer's first metatarsal and/or the first metatarsophalangeal joint. A second traction element may be positioned along the lateral edge of the forefoot region of the sole structure so that it extends approximately beneath the wearer's fifth metatarsal, fifth phalange, and/or fifth metatarsophalangeal joint. In this configuration, the outrigger structures of the first traction element and the second traction element may be configured so that both of the outrigger structures are positioned to extend toward the center of the forefoot region of the sole structure.

An article of footwear incorporating the above-described traction elements may comprise an upper, a sole member engaged with the upper, and a traction element attached to the sole member. The traction element may comprise a main body having an attached surface and a free end surface that are connected by a side wall, and a stabilizing element attached to the main body and extending away from the side wall of the main body. The attached surface of the main body may be attached to the sole member in any suitable manner. For example, the attached surface of the main body may be attached to the outsole and/or midsole of the sole member.

In one example embodiment, a traction element has a main body and a stationary stabilizing element. The main body and stationary stabilizing element may contact the ground as a single unit. The stabilizing element may provide the main body with support during the contact between the traction element and the ground. For example, the stabilizing element may provide lateral support when a shear force is applied to the traction element when it is in contact with the ground, e.g., during torsional loading when a wearer plants his or her forefoot into the ground and pivots or turns. Such a configuration may prevent or help reduce buckling or failure of the main body of the traction element during use.

In another example embodiment, a traction element has a main body and a stabilizing element that is capable of rotating about an axis, such as the axis defined at the attachment point between the stabilizing element and the main body. Any suitable activator may cause the stabilizing element to flex in response to a force. For example, the stabilizing element may flex in response to a particular type of force, e.g., torsional loading. In another example, a mechanical activator may cause the stabilizing element to flex in various directions. Such a mechanical activator may be configured to cause the stabilizing element to flex in response to a particular motion of the wearer, e.g., torsional loading that occurs during pivoting and quick stops and turning motions.

In either of the aforementioned examples, the stabilizing element provides the main body with additional stability and support during use. This may reduce the amount of wear upon the main body and thereby may increase overall durability of the traction element. Further, the stabilizing element may increase the reliability of the traction element by supporting the main body when it is in need of additional support, e.g., during failure or buckling of the main body. The stabilizing element also may be able to provide additional support and traction during targeted movements, such as when a wearer might apply a force in a particular direction or from a particular angle. The force from the targeted movement may trigger the engagement of the stabilizing element with the ground or surface in either the stationary example or the flexible example of the stabilizing element, as described above.

In another embodiment, at least one traction element provided with an article of footwear may comprise: (1) an actuator having a first portion and a second portion; and (2) an extender having a first side and a second side. The first side of the extender may be engaged with the second portion of the actuator. A tip may be attached to the second side of the extender. When the actuator is activated, the extender may be stretched from a first length to a second length.

The actuator of a traction element may be any mechanism that is capable of receiving a force and causing the extender to extend in response to the force. In some examples, the actuator may be a leaf spring. The first portion of the actuator may receive the force and transfer the force to the second portion of the actuator. The second portion of the actuator may cause the extender to extend.

The actuator may be "activated" when it receives a force. The actuator may be positioned to receive a force that is exerted during a particular action. For example, wearers may plant their foot and pivot on the first metatarsophalangeal joint (the joint between the big toe phalange and the metatarsal of the foot). This portion of the foot may receive a large force during motions such as pivoting, turning, quick starts for running, changing direction in motion, etc. An extendable traction element in accordance with this invention may be positioned to receive the force from such motions to extend the extender and thereby provide a traction element having a somewhat extended length, thus providing additional or enhanced traction to the wearer during these targeted motions. The actuator may include various materials that have elastic capabilities and high durability characteristics. For example, the actuator may include nylon materials, such as nylon 6,6, nylon 6, and/or thermoplastic polyurethane ("TPU") materials.

The actuator and the extender may be engaged with each other in any suitable manner. In the examples in which they directly contact each other, they may be removably or permanently attached to one another. Any suitable methods for attachment may be implemented to permanently attach the actuator to the extender, such as glues, cements, molding, bonding, and the like.

A traction element extender may be an elastic material that is capable of receiving a force from the actuator and extending from a first position to a second position as a result of that application of force. This extending action will have the effect of lengthening of the traction element (e.g., making the free end of the traction element move further away from a base surface of the sole). The extender may include various materials. In an example, the extender includes a soft TPU material, such as a TPU having a hardness rating of 60-70A. The extender may extend and retract in any suitable manner. For example, the extender may extend and retract in a linear fashion. In other examples, the extender may extend and retract in an accordion-style fashion. In yet another example, portions of the extender may be received into the interior space of the traction element when the extender is in its retracted position. When the extender is in its extended position, it may be linearly aligned with the rest of the side wall of the traction element. In embodiments where a spring is received into an interior space of the traction element, the spring may bias the extender back to its extended position when activated. Any combination of the aforementioned extender configurations may be implemented.

The extender may have a first side and a second side. The first side may be engaged with the second portion of the actuator in any suitable manner. For example, the second portion of the actuator may have a projection and the first side of the extender may define a recess. The projection of the second portion of the actuator may fittingly engage within the recess defined in the first side of the extender. In other configurations, another element may be situated between and prevent direct contact between the actuator and the extender. The term "engaged" is intended to include both direct and indirect contact between the actuator and the extender, and it is intended to include both permanent coupling and releasable engagements or mere contact. A lubricant material may be included or the materials of the engaging surfaces of the extender and the actuator may be selected so as to have a low coefficient of friction with respect to one another.

The traction element may also have a tip that may be attached to the second side of the extender. In some examples, the second side of the extender is a solid layer of material to which the tip may be attached. The tip may be attached to the extender in any suitable fashion, including but not limited to cement, glue, bonding, molding, and the like. In other examples, the second side of the extender includes an opening that permits the actuator and the tip to come into direct contact with each other. For configurations in which the actuator and the tip contact each other, the second portion of the actuator may define a recess and the portion of the tip that contacts the extender may have a projection that fittingly engages within the recess of the second portion of the actuator at a position within the opening of the extender.

A traction element tip may include a relatively hard, resilient material that is capable of withstanding the forces from a wearer's foot and is also capable of piercing or puncturing the ground to provide stable contact between the traction element and the ground. The tip may comprise the ground-contact surface of the traction element and must be capable of serving as the interface between the traction element and the ground. In some examples, additional friction-inducing characteristics may be included in the tip. For example, the tip may have a grooved surface or projections to provide the wearer with additional traction. In other examples, a friction-inducing material may be attached to the tip to provide additional traction capabilities.

The tip may include materials such as a TPU, polyurethane nylon material, and rubber. TPU is often measured in a hardness scale. For the tip, a harder TPU may be used, such as a TPU with a 95A/50D hardness. The tip in this case may need to withstand relatively strong forces. In the example in which the traction elements are positioned within the sole structure of articles of footwear, then a tip made of TPU should have a hardness rating that is able to withstand the forces that will be exerted upon the traction element by a wearer and can also withstand the forces applied by the ground or surface that the traction elements contact. The tip may include other materials that are capable of withstanding such forces, such as metal, rubber, and the like.

In some embodiments, a separate tip element can be omitted, and the free end of the extender may be used to directly contact the ground or other surface. In such situations, the bottom surface of the extender may be considered to be (or may function as) the "tip." If necessary, the bottom surface of the extender may be made from a suitable material and/or treated to provide adequate strength, hardness, durability, wear resistance, and/or other properties to make it suitable for contacting the ground.

When the actuator is activated, the extender may be stretched from a first length to a second length. The actuator may be activated in various manners, such as by the application of a force from a wearer's foot and the various conditions of the surface that the traction element is contacting. For example, the wearer may apply a force to the actuator by performing various actions, such as planting a foot and turning, pivoting, changing directions quickly, and the like. The force that is applied to the traction element by a wearer's foot may be shear, normal, or a combination thereof. The force may also be torsional, e.g., when the wearer's foot is planted in the ground and the wearer turns, pivots, or changes directions. The actuator may be configured to be activated by one or more actions performed by the wearer. The actuator may be positioned to be activated by the force of the wearer's foot in a targeted or specific type of activity. In this manner, the traction elements may be able to provide the wearer with additional traction in specific situations during which it is most needed.

The actuator may be configured to extend in relatively soft ground and may be retracted in relatively hard ground. The extender may be caused to retract when the traction element contacts ground that is relatively hard. When the traction element contacts ground that is relatively soft, the extender may be caused to extend because the force applied to the actuator by the wearer's foot exceeds the force necessary to pierce the soft ground with the traction element. In essence, the traction element will function like a regular traction element (in its retracted position) in hard ground, but will extend in softer ground. The conditions under which the traction element will extend can be controlled by varying the level of elasticity of the extender and the configuration of the actuator.

When the actuator is activated, the tip (i.e., the end of the extender or a separate tip component) may be moved from a first position to a second position. The first position of the tip may correspond to a first length of the extender (and a first overall length of the traction element) and the second position of the tip may correspond to a second length of the extender (and a second overall length of the traction element). The second length of the extender may be greater than the first length of the extender. The first length may correspond to the "retracted" position of the traction element and the second length may correspond to the "extended" position of the traction element. The retracted position of the traction element may be when the traction element is in contact with relatively hard ground and the force from a wearer's foot is not able to cause the extender to extend because the ground is too hard. In this case, the extender must also be made of a material that is capable of withstanding the force applied by the wearer's foot and the relatively hard ground so that it does not buckle or fail during use. Alternatively, the extender may completely retract into an interior space of the traction element when the traction element is in the retracted (or unstretched) position. The extended position of the traction element may occur when the traction element is in contact with relatively soft ground and the force of the wearer's foot is able to cause the extender to extend into the soft ground.

The extender may extend within a range of lengths. In some examples, the material that is used for the extender may be capable of withstanding the force applied by the wearer's foot when the tip of the traction element is in contact with hard ground to prevent the extender from failing, buckling, or breaking. Therefore, a material may be used for the extender that is capable of withstanding maximum force from a wearer's foot while still being elastic enough to be able to extend in soft ground. Such a material may be a soft TPU. The extension range of the extender may lengthen an overall axial or longitudinal length of the traction element from 0.5 mm to 10 mm, and in some examples from about 0.75 mm to 8 mm, or even from 1 mm to 6 mm. In some example structures, the extender itself may extend up to 3 millimeters between its first length (in the retracted position) and its second length (in the extended position). The extender may be capable of extending up to a range of any desired length.

In some embodiments, a traction element may be attached to a base plate assembly having an aperture and may include: (1) an actuator having a first portion and a second portion; (2) an extender engaged with the second portion of the actuator; and (3) a tip attached to the extender. The first portion of the actuator may be engaged with the base plate assembly. The extender has a first side and a second side. The first side of the extender is attached to the base plate assembly at or near the aperture, and the second side of the extender is attached to the tip. The tip may form a ground-contact surface of the traction element. When the actuator is activated, the extender may be caused to extend from a first length to a second length to thereby increase the axial or longitudinal length of the traction element. The base plate assembly may be attached to an article, such as the sole structure of an article of footwear. The base plate assembly may comprise one or more elements. The base plate assembly may help to secure the traction element to the sole structure. For example, a last board may be secured to or secured within a midsole of the sole structure so that the traction elements form at least a portion of the outsole.

In yet another embodiment, a traction element may be attached to a stud base having an opening and may include: (1) an extender having a first end and a second end; (2) a tip having a first surface and a second surface; (3) an actuator having a first portion and a second portion; and (4) a button that is engaged with the first portion of the actuator. The first end of the extender is attached to the stud base within the opening of the stud base so that the second end of the extender is positioned to extend through the opening of the stud base. A portion of the first surface of the tip is attached to the second end of the extender and the second surface of the tip forms the ground-contacting surface of the traction element. The first portion of the actuator is engaged with the second end of the extender. The button may be freely rotatable with respect to the first portion of the actuator. In some examples, the button is in direct contact with the second portion of the actuator. The button may be secured to the actuator in any suitable manner.

The traction elements described above may be incorporated into the sole structures of articles of footwear. Articles of footwear may comprise an upper, a sole structure attached to the upper, and at least one traction element secured to the sole structure. Any of the example traction element embodiments that are described above may be secured to the sole structure. Any number of traction elements having elongation capabilities of the types described above may be secured to the sole structure in any region or in multiple regions of the sole structure.

The sole structure may extend through any portion of an article of footwear. For example, the sole structure may extend through a forefoot region of the article of footwear. In such a configuration, the traction elements may be positioned within the forefoot region at a position beneath the first metatarsophalangeal joint. The first metatarsophalangeal joint is the position on the foot that is planted into the surface during a motion such as pivoting or turning. This joint may benefit from having additional traction during targeted movements, at least in some surface conditions.

The plurality of traction elements on the sole structure described above may be positioned in any suitable configuration. For example, a first traction element is positioned along the medial edge of the forefoot region of the sole structure and a second traction element is positioned along the lateral edge of the forefoot region of the sole structure. In this configuration, the first and the second traction elements are able to provide additional support and stability when the wearer's foot goes through the supination and the pronation phases of a normal step cycle. During the supination phase of a normal step, the wearer applies significant force onto the first metatarsophalangeal joint. When the supination phase ends, the wearer pushes off of the first metatarsophalangeal joint to continue in the normal step cycle. The wearer pushes off of the first metatarsophalangeal joint during turning actions, e.g., when the wearer plants a foot and pivots the ball of the foot or the "metatarsal region" of the foot. A significant portion of this force is absorbed by the first metatarsophalangeal joint (the joint between the metatarsal bone in the foot and the phalangeal bone of the big toe).

Figure 5:
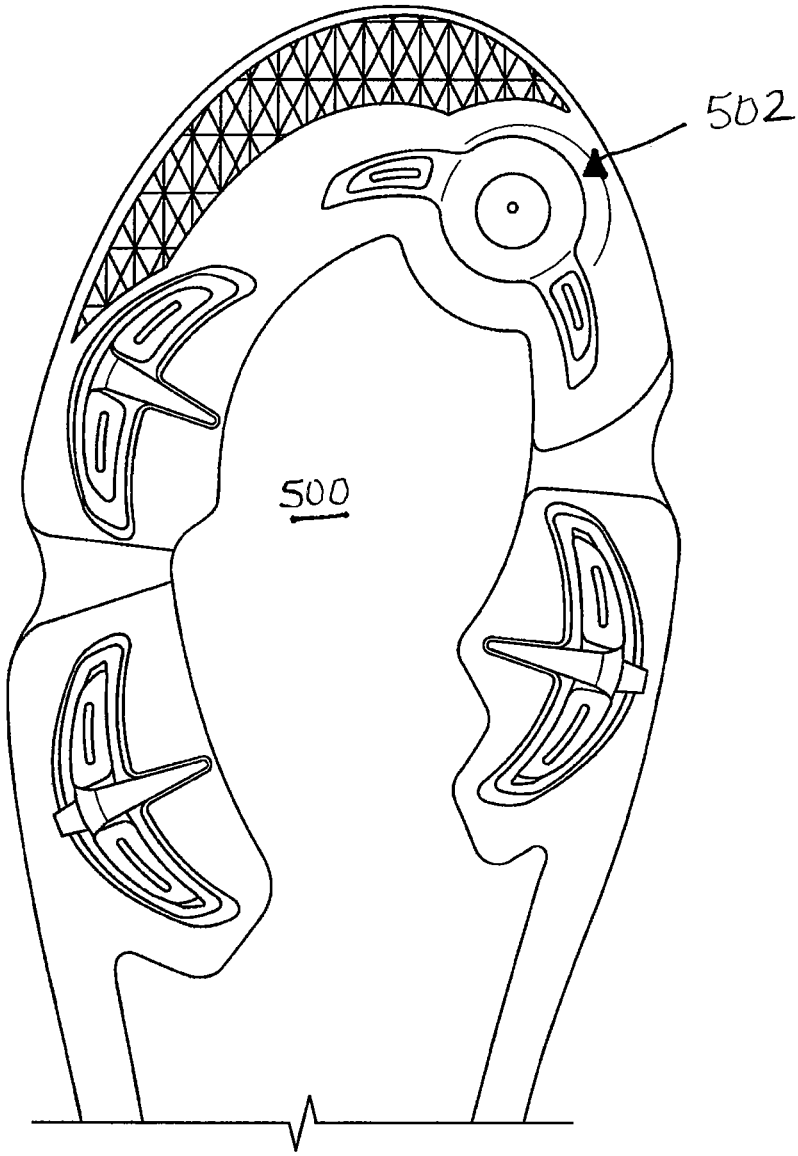
FIG. 5 illustrates a sole structure of an article footwear with an exemplary retractable and extendable traction element, according to aspects of the invention.

In another example, a traction element may be positioned on the sole structure beneath the first phalange (the "big toe"). As explained above, during the normal step cycle, a wearer applies significant force to the metatarsophalangeal joint. At the end of that motion, the wearer will push off of the first phalange. As illustrated in FIG. 5, an example traction element 500 according to some embodiments may be positioned on the sole structure 502 of an article of footwear so that it is it positioned beneath the first phalange of the wearer's foot. When the wearer completes a normal step cycle and pushes off of the first phalange, the traction element is positioned to extend and provide additional traction. In the example illustrated in FIG. 5, one traction element is positioned in the forefoot region of the sole structure approximately beneath the big toe or first phalange of the wearer. Any number of traction elements may be attached to the sole structure in any region (i.e., the forefoot region, the midfoot region, and/or the heel region).

FIG. 5 also illustrates an example sole structure having both a plurality of traction elements with stabilizers and a retractable and expandable traction element. A sole structure may have any suitable number of each kind of traction element. The traction elements may be positioned in any suitable configuration.

Each portion of the traction elements described above may be molded, cemented, glued, bonded, or otherwise attached to each other. Each element may be permanently or removably attached to another element.

Specific embodiments are described in more detail below. The reader should understand that these specific embodiments are set forth merely to illustrate examples of the invention, and they should not be construed as limiting the invention.

FIGS. 1-5 illustrate stabilizers for traction elements according to at least some embodiments. When the same reference number appears in more than one drawing, that reference number is used consistently in this specification and the drawings to refer to the same or similar parts throughout.

FIG. 1 illustrates an exemplary portion of an article of footwear 100 having a plurality of traction elements 102, 104, and 106 having stabilizing elements that are positioned in the forefoot region of an article of footwear 100. The traction elements 102, 104, and 106 are attached to the sole structure 108 of the article of footwear 100. At least a portion of the traction elements 102, 104, and 106 may be positioned within recesses 110 defined in the sole structure 108. The recesses 110 may be formed in a shape that is complementary to the shape of the traction elements 102, 104, and 106, although the recesses 110 may be any suitable shape, depth, design, or configuration. In the example illustrated in FIG. 1, the recesses 110 are shaped in a crescent shape, complementary to, but slightly larger than the crescent shape of the traction elements 102, 104, and 106. In some examples, the traction elements 102, 104, and 106 may not be positioned within a recess and may be attached to a flat portion of the sole structure 108. Any suitable configuration may be implemented for the attachment of the traction elements 102, 104, and 106 to the articles of footwear 100.

In FIG. 1, a first traction element 102 and a second traction element 104 may be positioned along the lateral edge 112 of the forefoot region of the sole structure 108 at a position along the longitudinal length of the fifth metatarsal and/or the fifth metatarsophalangeal joint. A third traction element 106 may be positioned along the medial edge 114 of the forefoot region of the sole structure 108 at a position corresponding approximately to the first metatarsal and/or first metatarsophalangeal joint.

The first traction element 102, the second traction element 104, and the third traction element 106 may be configured to engage with the ground in any desired manner The first traction element 102, the second traction element 104, and the third traction element 106 may each have a stabilizing element 116 that extends generally toward the center 117 of the forefoot region of the sole structure 108.

Each of the traction elements 102, 104, and 106 illustrated in FIG. 1 comprises a main body 118 and a stabilizing element 116. The main body 118 may comprise a first portion 120 and a second portion 122. The stabilizing element 116 has an attached end 124, a free end 126, and a center portion 128. The attached end 124 of the stabilizing element 116 is attached to the main body 118. The center portion 128 extends away from the attached end 124 of the stabilizing element 116 and positions the free end 126 a distance away from the main body 118 of the traction elements 102, 104, and 106. The exemplary traction elements illustrated in FIG. 1 may have either a stationary stabilizing element with respect to the main body or a flexible stabilizing element with respect to the main body.

The traction elements 102, 104, and 106 may be solid or may have a hollow interior. A portion of the traction elements 102, 104, and 106 may be solid and another portion may have a hollow interior. In the example illustrated in FIG. 1, a first cavity 132 is defined in the first portion 120 and a second cavity 134 is defined in the second portion 122 of the main body 118. The first cavity 132 and the second cavity 134 may extend along a portion of the length of the first portion 120 and the second portion 122 of the main body 118, respectively. The first cavity 132 and the second cavity 134 may be any shape or size. Multiple cavities may be defined in the first portion 120 and/or the second portion 122 of the main body 118.

The first cavity 132 and the second cavity 134 may permit the first portion 120 and the second portion 122 of the main body 118, respectively, to receive an applied force in various manners. Any number of cavities may be included in any portion of the traction elements 102, 104, and 106. In some examples, the traction elements 102, 104, and 106 may not include cavities.

The stabilizing element 116 may be attached to any portion of the traction elements 102, 104, and 106. In the example illustrated in FIG. 1, the stabilizing element 116 is attached to the traction elements 102, 104, and 106 generally at the center of the main body 118 and midway between the first portion 120 and the second portion 122 of the main body 118. The first portion 120, the second portion 122, and the stabilizing element 116 may be discrete components or they may be molded in a unitary construction.

The traction elements 102, 104, and 106 may be attached to the sole structure 108 in any desired manner. For example, the traction elements may be attached to a base plate that is then attached to remainder of the sole structure. The base plate may be attached to a midsole of the sole structure so that the traction elements form at least a portion of the outsole of the sole structure. The base plate may be any suitable material that is strong and lightweight. For example, the base plate may be a carbon fiber reinforced polymer. The traction elements 102, 104, and 106 also may be attached to the outsole or any other portion of the sole structure.

The sole structure 108 may have various areas of flexion that facilitate the flexion of the sole structure 108. The areas of flexion may facilitate this flexion by including a softer or more elastomeric material than the remainder of the sole structure. In other examples, the areas of flexion may facilitate flexion of the sole structure 108 by having a different shape than other areas of the sole structure 108. These areas of flexion may have a cavity or may form a concave shape that facilitates flexion of the sole structure 108. As illustrated in FIG. 1, a first area of flexion 136 may be positioned between the first traction element 102 and the second traction element 104. A second area of flexion 138 may be positioned adjacent to the third traction element 106. When the forefoot region of the sole structure 108 is caused to be flexed by a force, such as a movement of the wearer, then the sole structure flexes at the first area of flexion 136 and the second area of flexion 138. The first area of flexion 136 and the second area of flexion 138 are positioned to cause the sole structure 108 to flex along a natural flexion line of a wearer's foot when performing movements, such as a normal walking cycle, running, jumping, pivoting, or the like.

The traction elements 102, 104, and 106 may be manufactured in any desired manner. The traction elements 102, 104, and 106 may be molded as a unitary piece or may be molded in individual pieces and later assembled (e.g., the first portion 120, the second portion 122, and the stabilizing element 116 may each be molded individually, and then assembled post-manufacture).

The traction elements 102, 104, and 106 may be manufactured from any desired material or combination of materials, including but not limited to rubber, metals, and plastics. The plastics may include thermoplastic polyurethane ("TPU"), polyurethane nylon ("PU nylon"), or the like. Such materials may be any desired hardness. For example, the traction elements may include a TPU material having a hardness rating within the range of 70A-75D. Some example traction elements may include a plurality of materials. For example, the main body may include a first material and the stabilizing element may include a second material that is softer than the first material. Any combination of materials may be used for any portion of the traction elements.

Figure 2:
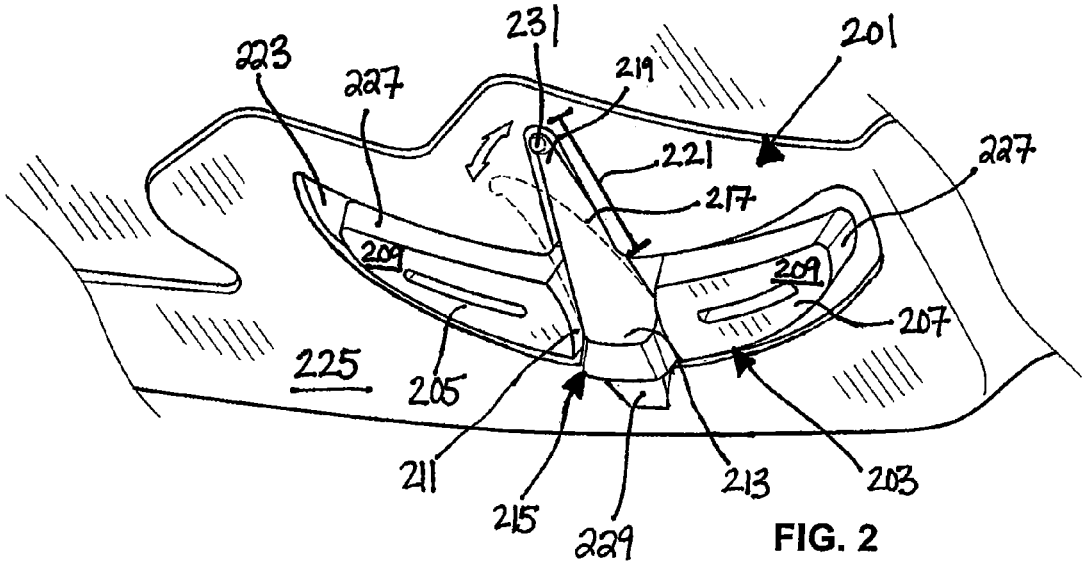
FIG. 2 is a perspective view of a traction element having a stabilizing element.

FIG. 2 shows a traction element 201 that could be used in place of one or more of traction elements 104, 104 and 106 of FIG. 1. The ground-contact surface of the traction element 201 may be defined by any portion of the main body 203. For example, the first portion 205 of the main body 203 and the second portion 207 of the main body 203 may have a free end surface 209 that defines a portion of the ground-contacting surface of the traction element 201. The main body 203 may define a channel 211 positioned between the first portion 205 and the second portion 207 of the main body 203. An attached end 213 of the stabilizing element 215 may be positioned within the channel 211 and attached to the main body 203 at the channel 211. In this example configuration, the center portion 217 of the stabilizing element 215 is caused to extend away from the main body 203 and position the free end 219 of the stabilizing element 215 at a distance 221 away from the main body 203.

As discussed above, an exemplary embodiment of a traction element may include a main body and a stabilizing element that remains stationary with respect to the main body. In the example of FIG. 2, the traction element 201 may include a main body 203 and a stabilizing element 215 that is capable of flexing with respect to the main body 203, as shown by the arrows in FIG. 2. In this example configuration, the center portion 217 and the free end 219 may be capable of flexing in various directions.

The traction element 201 may be situated within a recess 223 defined by the ground-contact surface of the sole structure of the article of footwear 225. In some examples, the recess 223 may be a height that is less than the height of the traction element 201 and thus the traction element 201 extends beyond the surface of the sole structure 225. The recess 223 may be shaped in any suitable shape. The recess 223 illustrated in FIG. 2 is shaped as a crescent. The main body 203 may also be any suitable shape. The exemplary main body 203 of the traction elements 201 illustrated in FIG. 2 is also crescent-shaped. The shape of the recess 223 and the shape of the traction element 201 may be complementary crescent shapes as shown in the example illustrated in FIG. 2. Any suitable combination of shapes may be implemented for either or both of the recess 223 and/or the main body 203 of the traction element 201. In some example configurations, the recess 223 and the traction elements 201 may be different shapes, such as the exemplary embodiment in which the recess 223 may be an oval shape and the traction element 201 may be a crescent shape. In other example configurations, the recess 223 and the traction element 201 are the same or a similar shape, such as the exemplary embodiment in which the recess 223 is an oval shape and the traction element 201 is an oval shape.

The stabilizing element 215 may extend away from the main body 203 of the traction element 201 at any suitable position. In the example illustrated in FIG. 2, the stabilizing element 215 extends away from the side wall 227 of the main body 203. The attached end 213 of the stabilizing element 215 is attached to the main body 203 at a position within the channel 211 defined between the first portion 205 and the second portion 207 of the main body 203. The attached end 213 may be generally flush with the side wall 227 of the main body 203 of the traction element 201 in this exemplary embodiment. A tail 229 of the stabilizing element 215 may extend away from the attached end 213 of the stabilizing element 215. The tail 229 may extend away from the side wall 227 of the main body 203 on the opposite side wall from the free end 219 of the stabilizing element 215, as illustrated in FIG. 2. In essence, the stabilizing element 215 may intersect the main body 203 of the traction element 201. The tail 229 may contact the ground-contact surface of the sole structure 225 in the embodiment in which the stabilizing element 215 may be flexed and in the embodiment in which the stabilizing element 215 is stationary with respect to the main body 203. Such a configuration may counterbalance flexion of the center portion 217 and the free end 219 of the stabilizing element 215.

The stabilizing element 215 may be any suitable shape. In the example illustrated in FIG. 2, the stabilizing element 215 is a round shape that is tapered from the attached end 213 to the free end 219. In another example, the stabilizing element 215 may be shaped in a polygon shape having a plurality of sides. The stabilizing elements 215 also may have a tip 231 at the free end 219. In the example illustrated in FIG. 2, the tip 231 is rounded and forms a hook-like tip that may engage the ground when the stabilizing element 215 contacts the ground. A configuration that includes tip 231 will provide additional gripping capabilities and provide support and stability between the stabilizing element 215 and the ground both when the stabilizing element 215 and the main body 203 operate as a single unit (e.g., when the stabilizing element is "stationary" with respect to the main body) and when the stabilizing element 215 is capable of flexing with respect to the main body 203. The tip 231 may be a hard or soft material.

Figure 3:
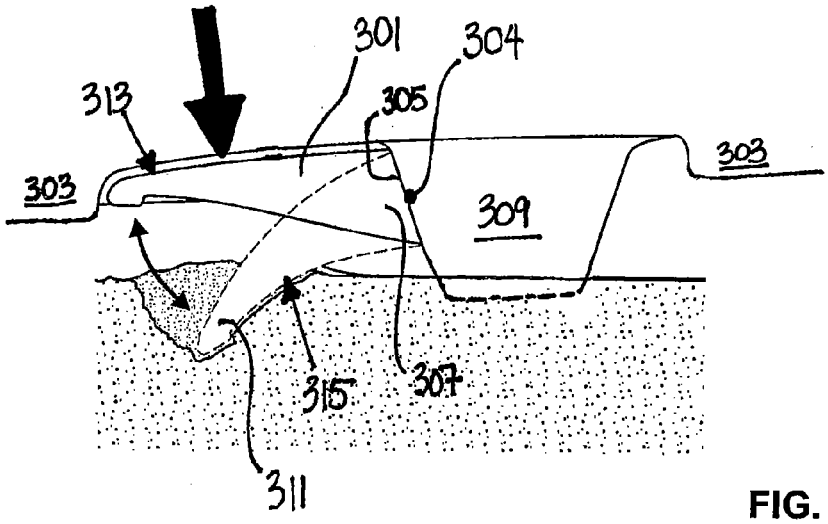
FIG. 3 is a side view of a traction element having a stabilizing element.
Figure 4:
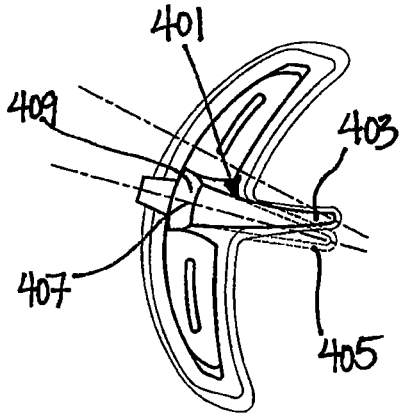
FIG. 4 is a bottom plan view of a traction element having a stabilizing element.

Stabilizing elements in some embodiments may be flexed in any desired direction. FIGS. 3 and 4 illustrate additional examples of stabilizer element flexion in some embodiments. The stabilizing element may be flexed in response to various forces. For example, the traction element may be attached to a flexible base plate. The base plate may be sufficiently flexible to allow the free end of the stabilizing element to engage the ground. When the wearer's foot applies a force to the sole structure, the base plate flexes and may cause the stabilizing element to extend away from the surface of the sole structure. The stabilizing element may be positioned at various places on the sole structure so that when the wearer engages in a particular activity, such as running, pivoting, turning, and the like, then the stabilizing element extends away from the sole structure and engages with the ground.

In an alternative embodiment, the stabilizing elements may remain stationary with respect to the main body of the traction element. This exemplary embodiment of the traction elements also may be attached to a flexible base plate. When the wearer's foot applies a force to the sole structure, the base plate may flex and cause the main body and the stabilizing element of the traction element as a single unit to extend away from sole structure and engage with the ground or surface.

In the examples that have a flexible stabilizing element, an activator may be positioned within the sole structure so that when the activator is activated by a force (e.g., a force applied by a wearer's foot), the activator engages with the stabilizing element to cause it to extend away from the surface of the sole structure. The activator may be attached to any portion of the article of footwear. For example, the activator may form a portion of the midsole at a position that extends between the portion of the wearer's foot that creates the applied force and the stabilizing element of the traction element. The activator may also be attached to the insole and/or a sock liner in a similar position. The activator may be an actuator, such as a leaf spring or any other type of spring. The activator also may be a simple button-like device so that when the wearer applies force to a particular portion of the sole structure, the button engages with the stabilizing element to cause it to extend. Any activator element may be implemented in this design.

In FIG. 3, as exemplary traction element is shown having a flexible stabilizing element 301. The stabilizing element 301 may flex away from the surface of the sole structure 303 around an axis 304 defined by the point of attachment 305 between the attached end 305 of the stabilizing element 301 and the main body 309, as shown in dotted line in FIG. 3. FIG. 3 illustrates how the stabilizing element 301 may engage with the ground in a flexed position 315. The free end 311 of the stabilizing element 301 may also engage with the ground when the stabilizing element 301 is in a resting (or neutral) position 313 if the sole structure 303 of the article of footwear is rotated from a medial edge to a lateral edge (e.g., when a wearer may cause the article of footwear to be rolled over the medial edge or lateral edge of the foot and thus the sole structure). The stabilizing element 301 may flex to a flexed positioned 315.

FIG. 4 illustrates an exemplary traction element having a flexible stabilizing element 401. The stabilizing element 401 may be flexed from a first position 403 to a second position 405 within a plane generally parallel to the plane defined by the ground-contact surface of the sole structure. The first position 403 and the second position 405 may represent a "side-to-side" motion around an axis 407 defined by the attached end 409 of the stabilizing element 401. The stabilizing element 401 may be flexed in any direction around the axis 407 of the attached end 409 of the stabilizing element 401.

Additional embodiments of stabilizer elements are described in connections with FIGS. 15 and 18A-19.

Figure 6:
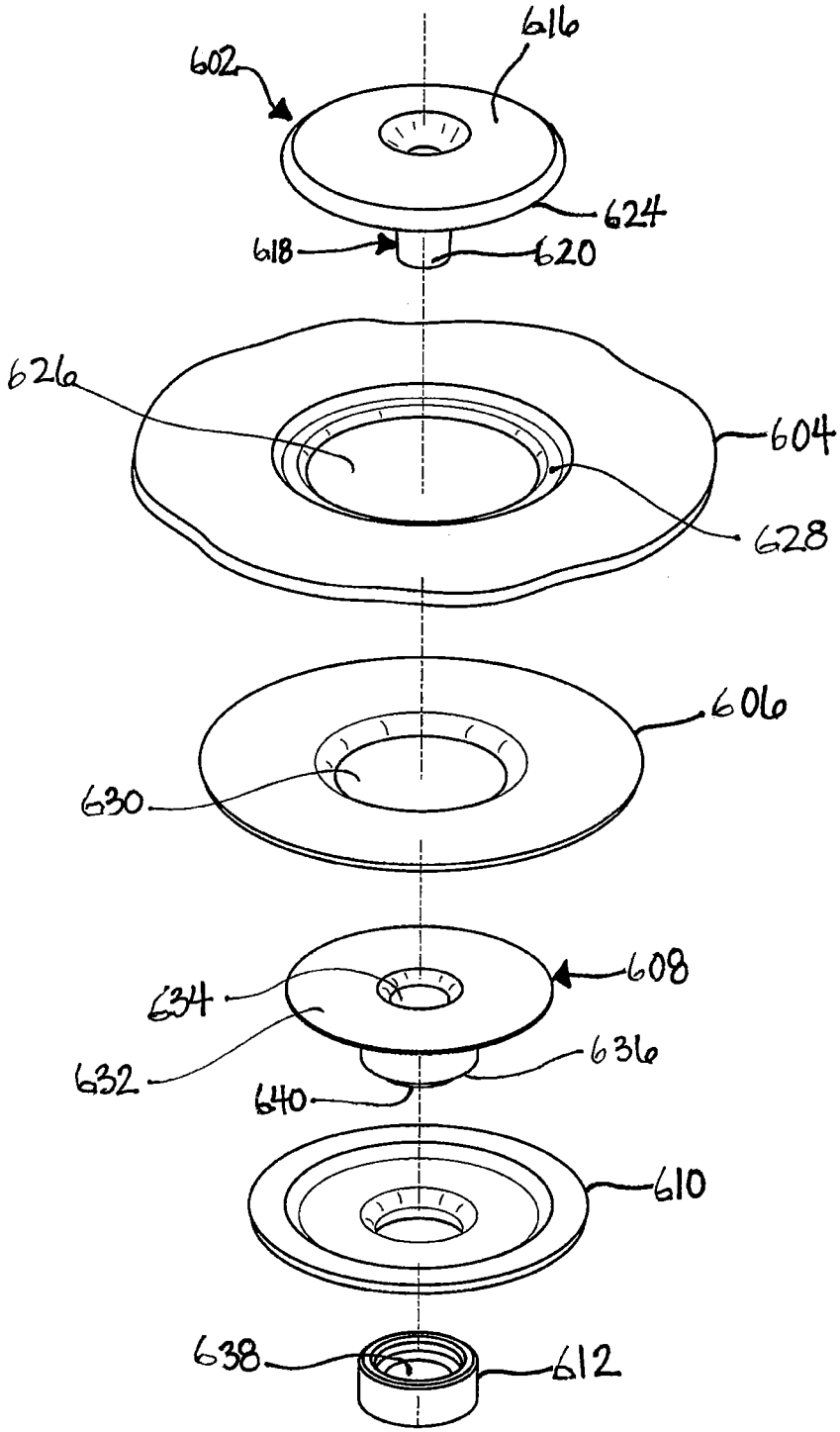
FIG. 6 is an exploded view of an example traction element.
Figure 7:
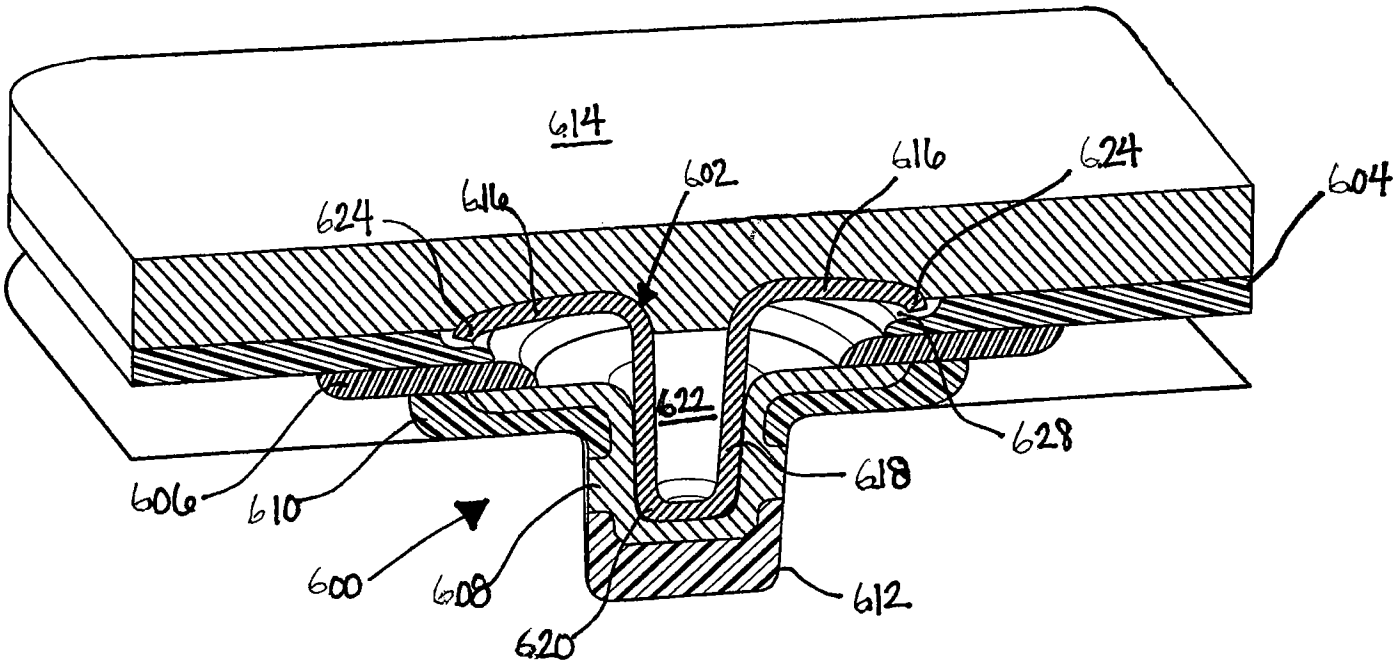
FIG. 7 is a cross-sectional view of an example traction element in a retracted and/or unactuated position, according to at least some embodiments.
Figure 8:
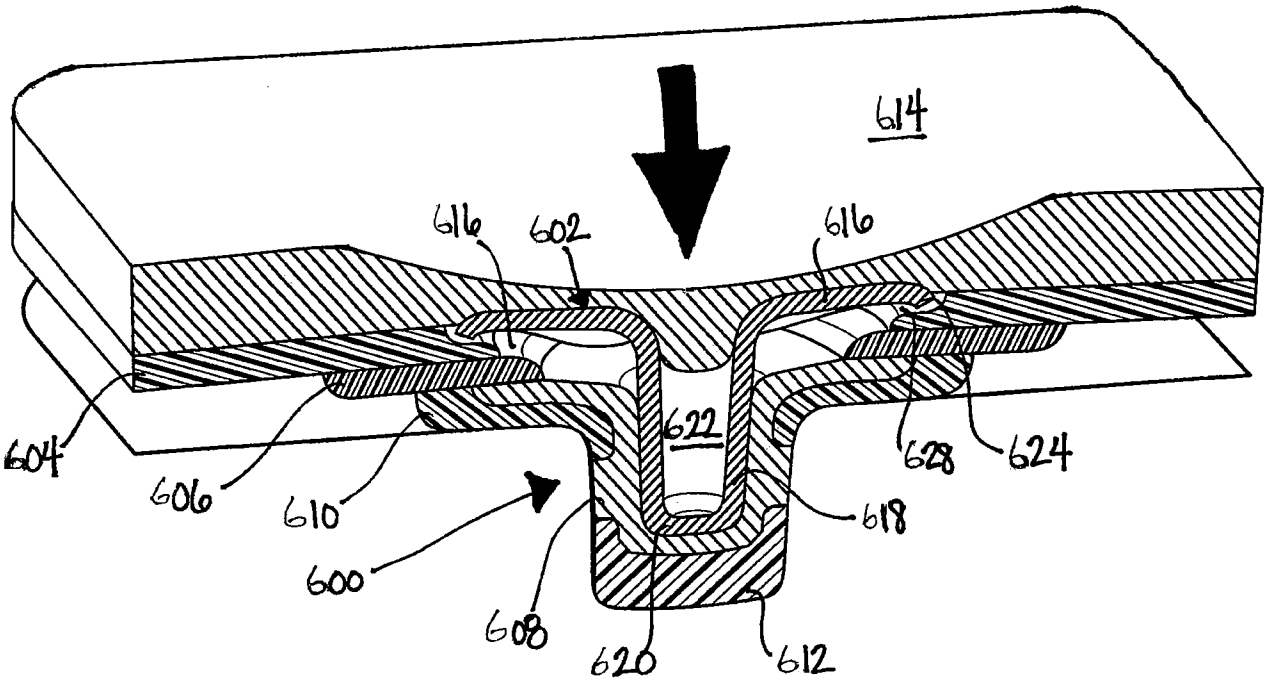
FIG. 8 is a cross-sectional view of an example traction element in a partially extended position, according to at least some embodiments.

FIGS. 6-8 illustrate a first example embodiment of a retractable and extendable traction element in a shoe. The traction element in these figures includes a stud assembly having an extender 608, a plate inlay 610, and a tip 612. The traction element further includes a leaf spring actuator 602, operation of which is described below. The traction element is secured to a base plate 606. Although shown as a disc for convenience, base plate 606 may be a plastic outsole element that extends over a substantial portion of the outsole length and that may also have non-extendable traction elements formed thereon. A last board 604 is contained in (or otherwise attached to) an upper (not shown). Although shown with a circular shape in FIG. 6, last board 604 may have a shape that extends over a non-circular region of the shoe interior.

As seen in FIG. 7 (a cross-sectional view of a portion of a shoe including the traction element of FIG. 6), a sock liner 614 rests above last board 604. The sock liner 614 is designed to provide a wearer with comfort and may prevent chaffing, rubbing, or other discomfort resulting from contact between the wearer foot and the sole structure and upper of the shoe. The sock liner 614 may include any suitable materials, and may be removable from the article of footwear. In some examples, the article of footwear does not have a sock liner. In other examples, the sock liner 614 is an insole.

Leaf spring actuator 602 may be any mechanism that is capable of receiving a force and causing the extender 608 to extend in response to that force. In the embodiment of FIGS. 6-8, the leaf spring actuator 602 includes a disc-shaped leaf spring as a first portion 616. A second or center portion 618 forms a projection 620 that extends away from a sole structure of the shoe. The center portion 618 is positioned approximately in the center of the first portion 616 and has a hollow interior 622. In response to force from a wearer's foot, and as seen in FIG. 8 (a cross-sectional view similar to FIG. 7), the sock liner 614 may partially extend into the hollow interior 622.

Figure 9:
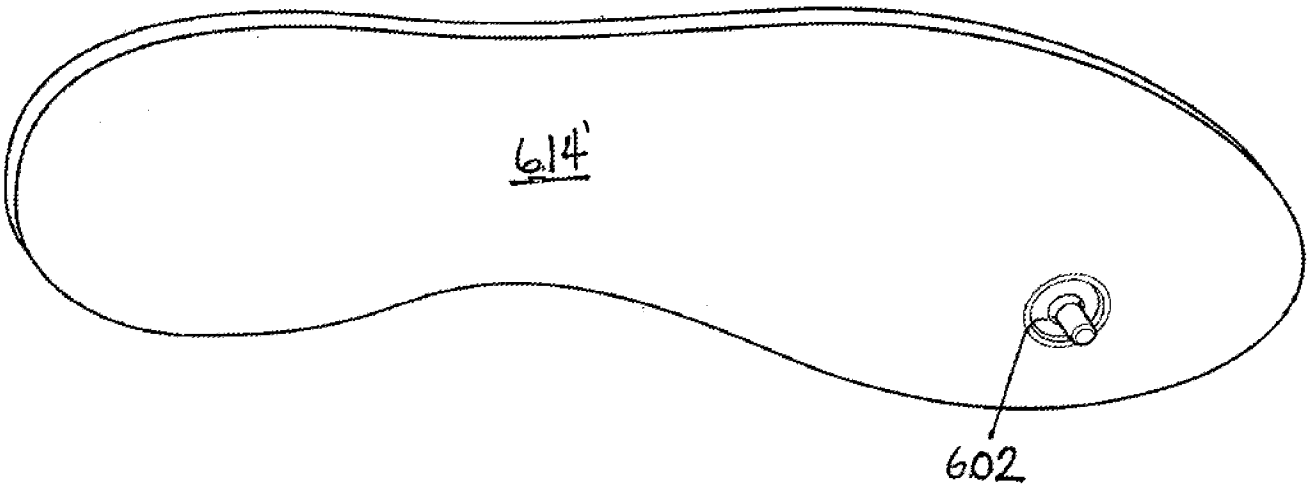
FIG. 9 illustrates an example sole structure having an insole with an actuator, according to at least some embodiments.

In alternate embodiments, and as illustrated in FIG. 9, an actuator 602' may be joined or attached to a sock liner 614' or an insole. The actuator 602' may also be selectively removable from the sock liner 614' or insole. The combination of the actuator 602' and sock liner 614' or insole may also be selectively removable from the remaining components of the traction element and from the shoe. The replaceable nature of a sock liner 614' or other insole in this example configuration would facilitate easy replacement for worn parts and the ability to easily clean or repair the insole and/or the actuator (s). In another embodiment, a sole structure may include a sock liner or insole and a plurality of actuators, which actuators may be joined to the sole or insole. The actuators may be removable from the sock liner or insole and replaceable at the same (or at different) points of attachment. The attachment points may include a first location positioned along the lateral edge of the forefoot region of the sock liner or insole and a second location approximately beneath the first phalange ("big toe") of a wearer at a position along the medial edge of the sock liner or insole. In some such embodiments, the sole structure may have multiple actuators, while in other embodiments a single actuator may be alternately attached to attachment points at either the first or second location. The points of attachment may also be positioned in other configurations on the sock liner or insole. The attachment between the sock liner or insole and the actuator(s) may be any suitable means of attachment, including but not limited to bonding, gluing, cementing, molding, and mechanical connectors.

A sole structure may include a base member and a traction element extending from the base member. The traction element includes a first end attached to or integrally formed with the base member, a free end opposite the first end, and at least one wall member extending between the first end and the free end. At least a portion of the at least one wall member is constructed from a stretchable material such that the traction element is changeable from a first axial length to a second axial length that is longer than the first axial length. This configuration may be shaped to mate with the insole and actuator combination described above.

In some embodiments, the actuator may be positioned within an interior space of the traction element described above. The insole and actuator portion of the sole structure may be selectively removable from the base member and traction element portion of the sole structure. These portions may be separately manufactured or may be manufactured together. The insole and actuator portion of the sole structure may be interchangeable with several different configurations of the base member and traction element portion of the sole structure.

Returning to FIG. 6, the edge 624 of the disc-shaped leaf spring actuator 602 may contact a last board 604 having a hole 626 therein. The center portion 618 of the actuator 602 may extend through the hole 626. The last board 604 may be attached to the sole structure of the article of footwear in any suitable manner. In some embodiments, for example, a last board 604 may be glued to an upper, with the upper and last board combination then secured to the sole structure. The edge of last board 604 along the hole 626 defines a shoulder 628 on which the edge 624 of the disc-shaped leaf spring actuator 602 rests. Edge 624 may be secured to edge 628, or actuator 602 may rotate within hole 626.

As seen in FIG. 7, base plate 606 may be secured to the last board 604 on the opposite side of the last board 604 from the leaf spring actuator 602. In other embodiments, upper material may be interposed between last board 604 and base plate 606. The base plate 606 includes a hole 630 through which center portion 618 extends. The hole 630 in the base plate 606 is aligned with the hole 626 in the last board 604 to allow for center portion 618 of the actuator 602 to easily extend therethrough. The hole 630 in the base plate 606 may have a radius that is slightly smaller than the radius of the hole 626 in the last board 604. The base plate 606 may be attached to the last board 604 (or to an upper attached to last board 604) in any suitable fashion including, but not limited to bonding, cement, glue, molding, and the like.

A plate inlay 610 helps secure the extender 608 (with tip 612) to the base plate 606. Specifically, the plate inlay 610 surrounds the disc-shaped portion of the extender 608 and is secured to the base plate 606. A first side 632 of the extender 608 includes a recess 634 that is shaped to receive the center portion 618 of the actuator 602. The center portion 618 of the actuator 602 is fittingly engaged within the recess 634. The first side 632 of the extender 608 is secured to the base plate 606. This portion of the extender 608 may also be disc-shaped. The radius of the recess 634 of the extender 608 may be smaller than the radius of both of the last board's hole 626 and the base plate's hole 630. The recess 634 defines a blind hole, i.e., a hole with a closed end. The actuator 602 does not extend through the extender 608 in this example (i.e., the bottom of projection 620 contacts the bottom end surface 640 of the extender 608), although it may extend through the extender 608 in other embodiments.

The tip 612 is attached to a second side 636 of the extender 608 and forms the ground-contact surface of the traction element. The tip 612 has a cavity 638 into which an end 640 of the extender 608 is fitted. As illustrated in FIGS. 7 and 8, the side wall of the traction element comprises portions of both the extender 608 and the tip 612 (and optionally, portions of the plate inlay 610). The extender 608 facilitates the extension of the axial or longitudinal length of the traction element. In FIG. 7, the traction element is shown in its retracted position.

Figure 10B:
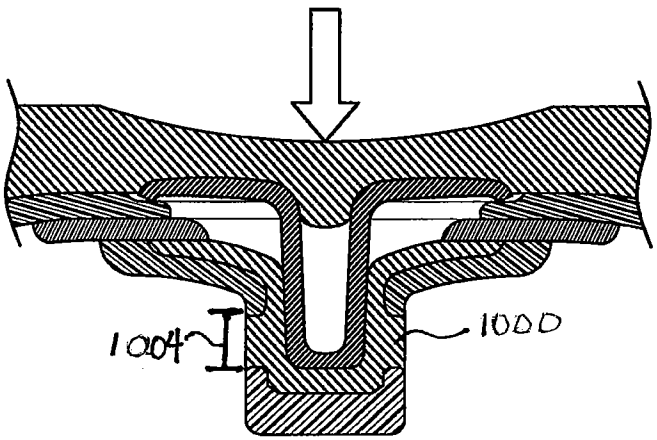
FIGS. 10A and 10B illustrate an exemplary traction element having an extender positioned at a first length and a second length, respectively.
Figure 10A:
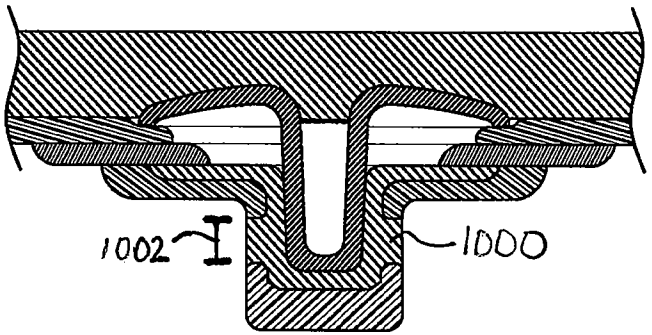

FIG. 8 shows the traction element in a partially extended position. Downward force from the wearer foot in the direction of the arrow is transferred through sock liner 614 and compresses section 616 of leaf spring element 602. This downward force is transferred through center section 618 and end 620 to the bottom of the blind hole 634 in extender 608. This causes extender 608 to elongate, thereby extending the traction element of which extender 608 is a part. The difference between the length of extender 608 in its retracted state and the length of extender 608 its fully extended state may be, for example, approximately 3 millimeters. As illustrated in FIGS. 10A and 10B, an extender 1000 (similar to extender 608) may have a first length 1002 in its retracted position and a second length 1004 in an extended position. Extender 1000 is not fully extended in FIG. 10B. In some embodiments, length 1002 is 0.5 mm and length 1004 at full extension is 10 mm. In still other embodiments length 1002 is 0.75 mm and length 1004 at full extension is 8 mm. In yet other embodiments length 1002 is 1 mm and length 1004 at full extension is 6 mm. In further embodiments the fully retracted length 1002 and the length 1004 at full extension may have other values.

Figure 11:
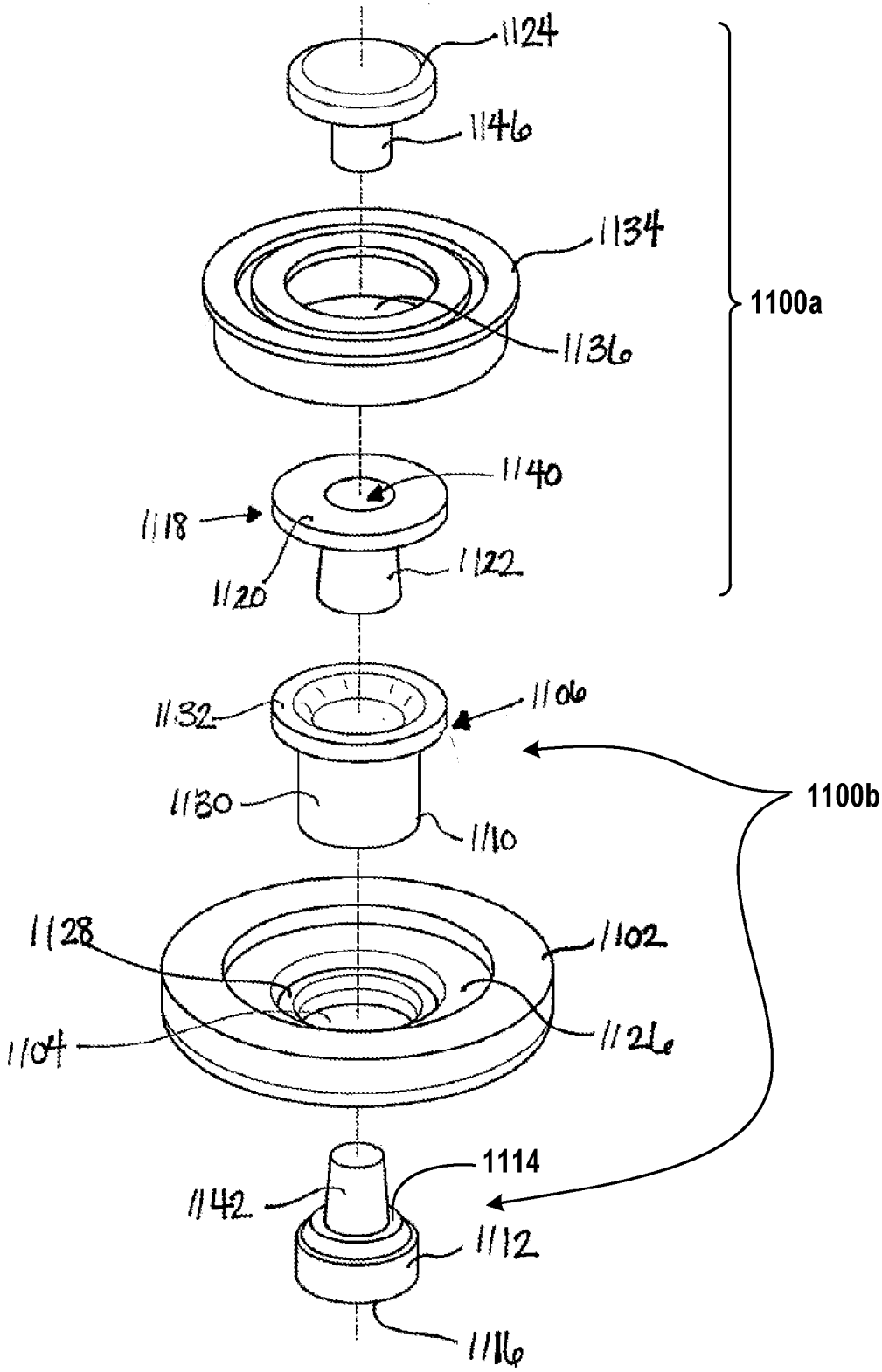
FIG. 11 is an exploded view of another example traction element.
Figure 12:
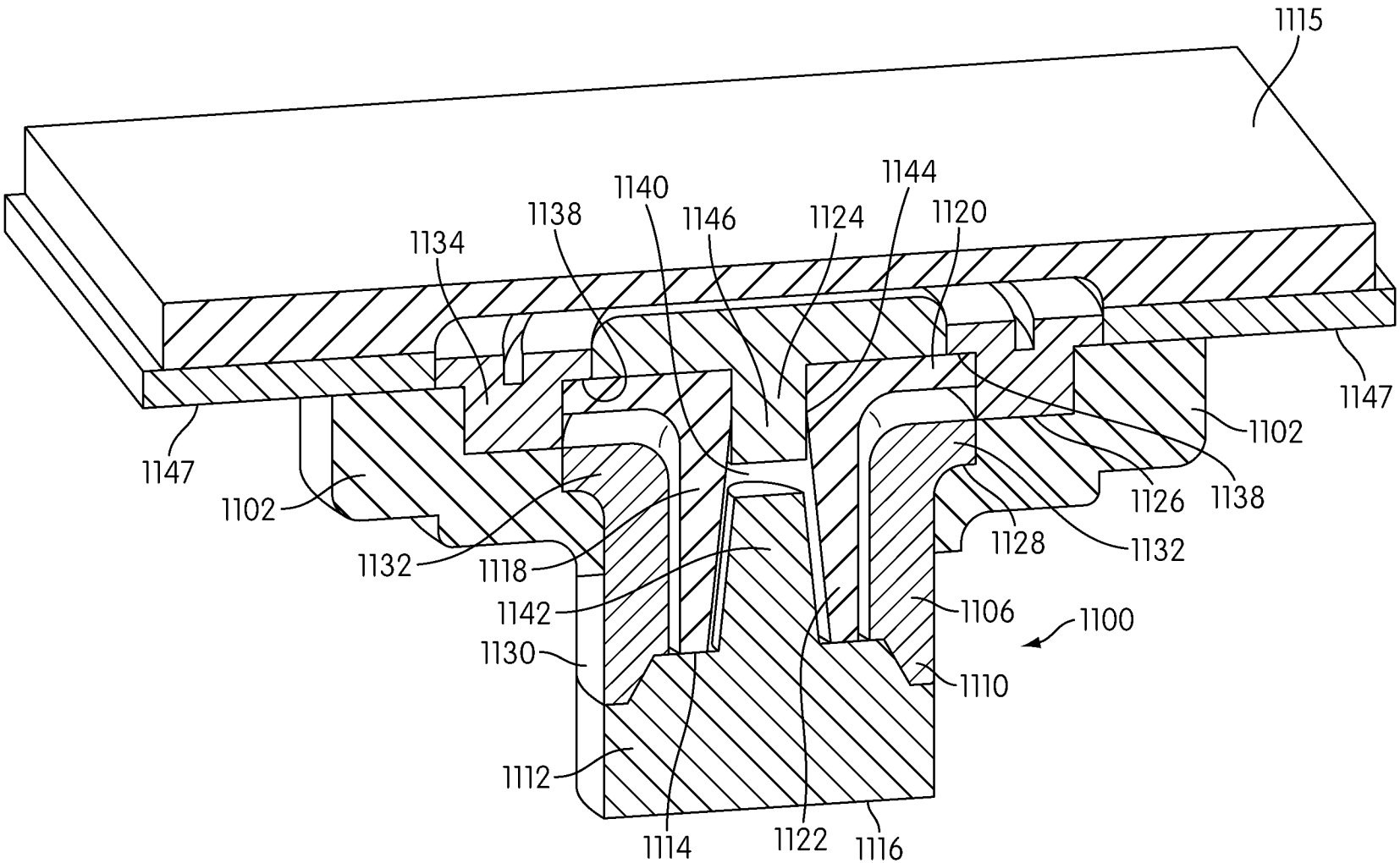
FIG. 12 is a cross-sectional view of another example traction element in a retracted and/or unactuated position, according to at least some embodiments.
Figure 13:
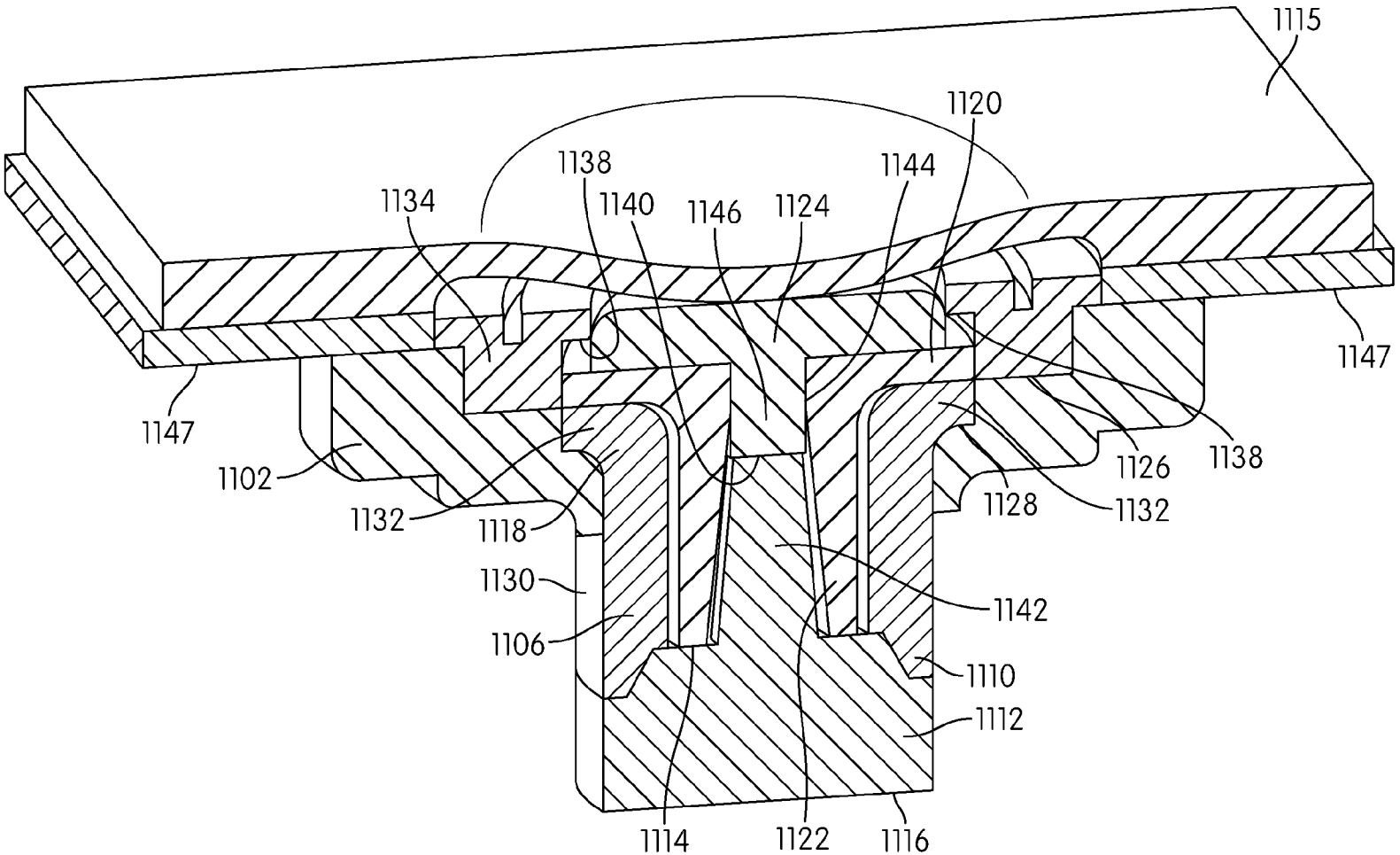
FIG. 13 is a cross-sectional view of another example traction element in a partially extended position, according to at least some embodiments.

FIGS. 11-13 illustrate another example of a traction element structure in accordance with this invention. The traction element structure of FIGS. 11-13 includes an actuator sub-assembly 1100*a* and a stud sub-assembly 1100*b*. Actuator sub-assembly 1100*a* includes a button 1124, a stopping mechanism (collar) 1134 and an actuator 1118. Stud sub-assembly 1100*b* includes an extender 1106 and a tip 1112. Extender 1106 rests within a stud base 1102. Although shown as a circular structure for convenience, stud base 1102 may be part of a plastic outsole element that extends over a substantial portion of the shoe outsole and that may include fixed traction elements formed thereon. Although not shown in FIG. 11, a toe lasting board 1147 similar to board 604 (FIGS. 6-8) is located between sock liner 1115 (shown in FIGS. 12 and 13) and stud base 1102 and may have an opening (similar to opening 626 of board 604) located over actuator sub-assembly 1100*a*. Portions of material from an upper may also be located between toe lasting board 1147 and stud base 1102.

Stud base 1102 has a first shoulder 1126 and a second shoulder 1128. The radius of the interior of the stud base 1102 at the first shoulder 1126 is greater than the radius of the interior of the stud base 1102 at the second shoulder 1128. The extender 1106 includes a body 1130 that is shaped like a tube and a collar 1132 attached to an end of the body 1130. The tube-shaped body 1130 is positioned to extend through the opening 1104 of the stud base 1102, with the collar 1132 of the extender 1106 resting upon the second shoulder 1128. A portion of the first surface 1114 of the tip 1112 is in contact with the second end 1110 of the extender 1106. The second surface 1116 of the tip 1112 forms the ground-contacting surface of the traction element. A stopping mechanism 1134 having a ring shape is positioned within the interior space of the stud base 1102 so that it rests upon the first shoulder 1126. Positioned between the stopping mechanism 1134 and the extender 1106 is the actuator 1118.

Stopping mechanism may be glued or otherwise secured in stud base 1102 so as to rest on shoulder 1126. In other embodiments, a stopping mechanism may be configured so as to be freely rotatable with respect to the extender and the stud base. In such embodiments, the stopping mechanism is freely rotatable so that it may receive torsional loading yet reduce the amount of torsional force and/or shear that is transferred to the traction element, but still permit normal force components of the applied torsional loading to be transferred to the traction element and cause the extender to extend. Such a configuration may reduce the amount of unnecessary wear on the traction element and may increase its durability. In such embodiments, a lubricant material may be included or the materials of the engaging surfaces may be selected so as to have a low coefficient of friction between the stopping mechanism and the stud base and extender.

The opening 1136 of the ring of the stopping mechanism 1134 contains a seat 1138 on its underside (see FIGS. 12 and 13). A second portion 1122 of the actuator 1118 is positioned to extend into the tube-shaped body 1130 of the extender 1106. The first portion 1120 of the actuator 1118 is positioned between the seat 1138 of the stopping mechanism 1134 and the upper surface of collar 1132 of extender 1106. In this manner, the seat 1138 of stopping mechanism 1134 provides an upward stop for the actuator 1118.

The actuator 1118 has an opening 1140 that extends from the first portion 1120 of the actuator 1118 through the second portion 1122. A button 1124 fittingly engages with the first portion 1120 of the actuator 1118. The button may be made of any material, such as a high density polyethylene ("HDPE") or another plastic. The button 1124 may be freely rotatable within the first portion 1120 of the actuator 1118 to help facilitate torsional loading and reduce the amount of shear and torsional forces that are applied to the traction element. A lubricant material may be included or the materials of the engaging surfaces of the button 1124 and the first portion 1120 of the actuator 1118 may be selected so as to have a low coefficient of friction with respect to one another.

As seen in FIGS. 12 and 13, a portion 1146 of the button 1124 extends into the opening 1140 of the actuator 1118. A surface 1114 of the tip 1112 is contacted by the lower face of second portion 1122 of actuator 1118. A projection 1142 extends upward from surface 1114 through the interior of body 1130 (of extender 1106) and into opening 1140 of actuator 1118. In response to a downward force on actuator 1118, second portion 1122 contacts surface 1114 and causes the extender 1106 to extend and the length of the traction element to increase.

Engagement between the button 1124 and the actuator 1118 may help to distribute the force from a wearer's foot equally across the surface of the first portion 1120 of the actuator 1118. As indicated above, the button 1124 may be rotatable within the hollow tube 1140 of the actuator 1118. In another embodiment, the button 1124 may be fittingly engaged within the hollow tube 1140. Additionally, the button 1124 may have a smooth surface that is more comfortable for the wearer's foot to contact.

An actuator assembly comprising the button and the actuator may fittingly engage with the stopping mechanism. The term "fittingly engage" means having closely complementary surfaces so as to tightly fit and/or prevent rotation with respect to one another. A lubricant material may be included or the materials of the engaging surfaces may be selected so as to have a low coefficient of friction with respect to one another.

The actuator assembly may freely rotate when torsional loading is applied by a wearer's foot. Such a configuration permits the actuator assembly to rotate with the wearer's foot and the upper portions of the article of footwear during activities that induce a torsional load, such as pivoting, changes in direction, and turning. This configuration will also reduce the torsional load that is applied to the traction element during these motions and thus increase the durability of the traction element. Alternatively, the stopping mechanism may fittingly engage with the actuator by one or more grooves defined in the stopping mechanism that mate with corresponding tab(s) defined in the first portion of the actuator. In one example, there are two opposing tabs defined along the edge of the first portion of the actuator and two corresponding grooves in the stopping mechanism that are shaped to receive the tabs. In another example, a series of six evenly spaced tabs are defined along the edge of the first portion of the actuator and six evenly spaced corresponding grooves are defined in the stopping mechanism that receives the tabs. Any suitable manner of connecting the stopping mechanism and the actuator may be implemented.

Any edges or surfaces in the elements that are described above may be beveled, straight, rounded, or any other desired configuration. Further, the elements may engage with one another by a flat surface or by a mechanical connector, such as a male or female connection, grooves, or other complementary parts.

The retractable and extendable traction elements may be manufactured in any desired manner. For example, the traction elements may be molded. In an example manufacturing process, a first mold may be formed of the extender, the stud base (or base plate assembly), and the tip. The first mold is formed by a shot sequence comprising a first shot that includes forming the extender and a second shot that includes forming the stud base/base plate assembly and the tip. The extender, the stud base/base plate assembly, and the tip become chemically bonded to each other when the plastics cool in the mold. In other embodiments, a stud tip is first formed in a stand-alone mold. The molded stud tip is then placed into a second mold. A stud base is then molded into the second mold. After forming the stud base, an extender is molded into the second mold so as to connect the stud tip and the stud base.

Once cooled, the first mold may then be inserted into a second mold. A third shot may be injected into the second mold. The third shot may include forming the plate inlay. In the second mold, the plate inlay of the third shot may be wrapped around at least a portion of the extender. Alternatively, all of the shots in this shot sequence may be formed in the same mold. Additional steps in the shot sequence may be included. The elements of the traction elements may be chemically bonded to one another by varying the pressure, time, and temperature at which the shot sequence is performed.

Figure 14:
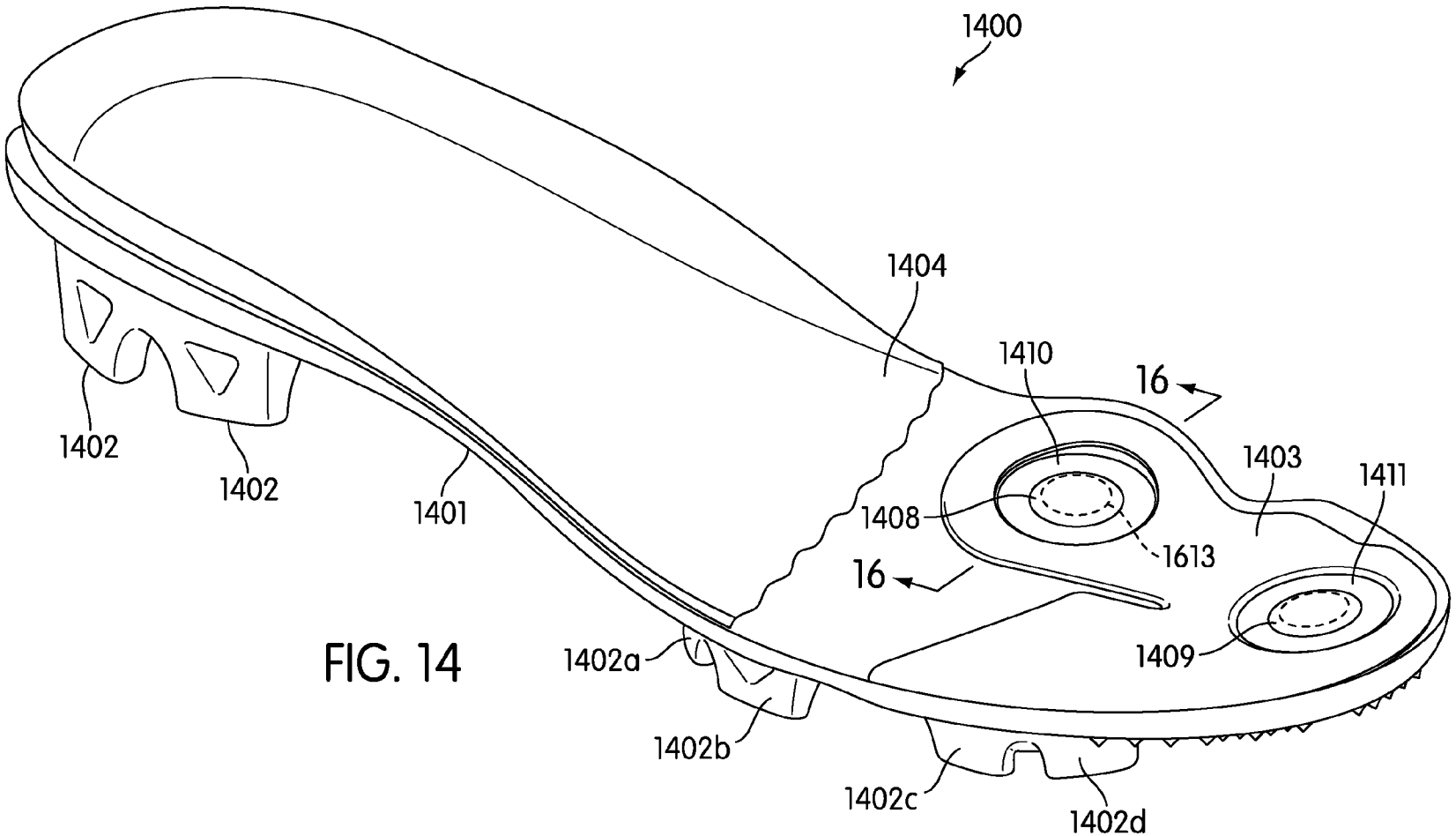
FIG. 14 shows a portion of a shoe having two extendable traction elements according to at least some additional embodiments.

FIG. 14 shows a portion of a shoe 1400 having two extendable traction elements according to another embodiment. Shoe 1400 has a sole structure that includes a base plate 1401. As explained in further detail below, base plate 1401 also include holes through which actuators move so as to elongate extenders 1501 and 1502 of two extendable traction elements 1503 and 1504 (FIG. 15).

Figure 15:
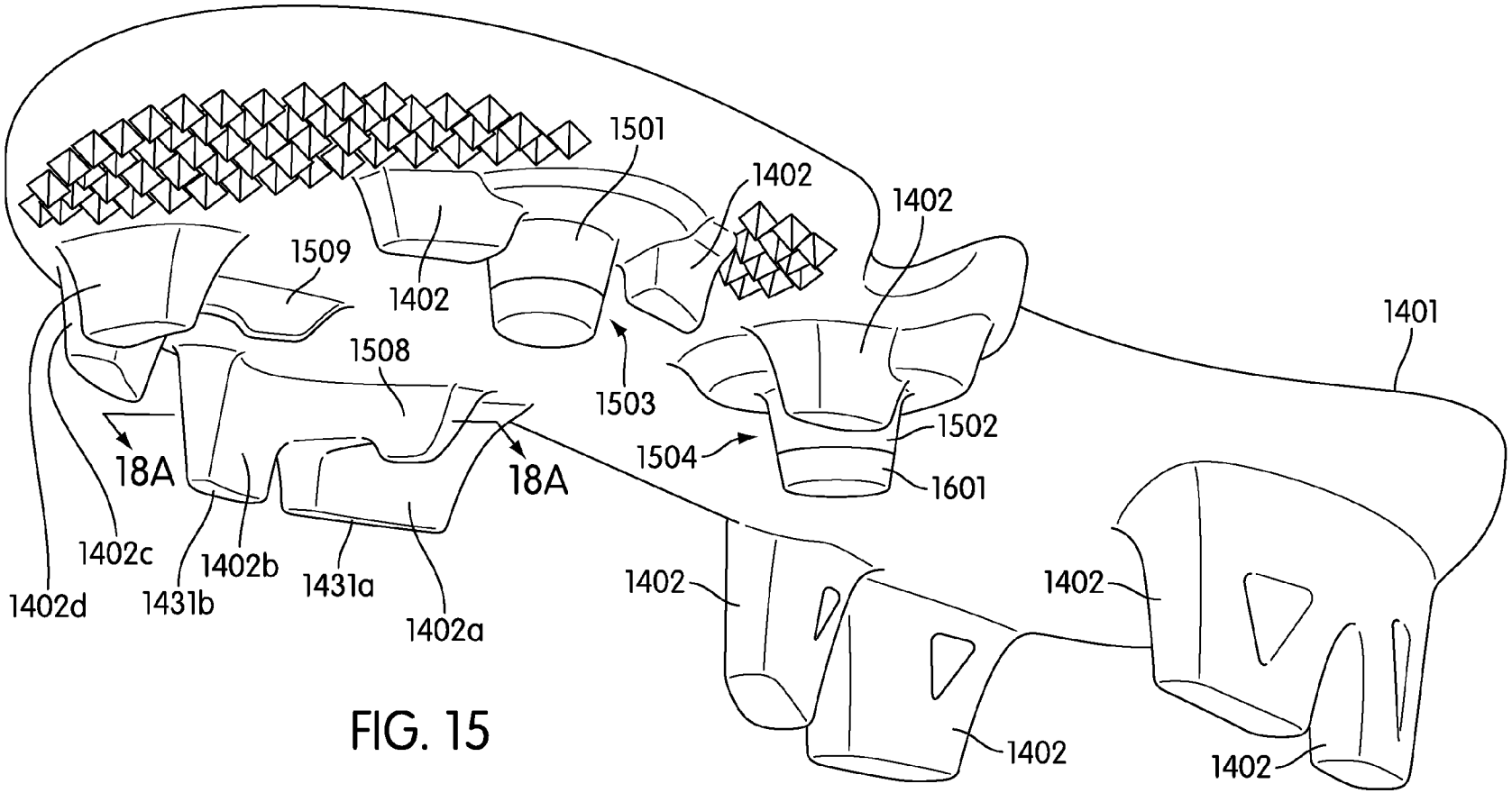
FIG. 15 is a perspective view of the lower side of the shoe portion from FIG. 14.

As seen in FIG. 14, and as is seen in more detail in FIG. 15, base plate 1401 also includes multiple fixed (non-extending) traction elements 1402. Base plate 1401 further includes a first stabilizer 1508 associated with traction elements 1402*a* and 1402*b* and a second stabilizer 1509 associated with traction elements 1402*c* and 1402*d*. Stabilizers 1508 and 1509 are discussed below in connection with FIGS. 18A through 19. Ground-contacting surfaces 1431*a* and 1431*b* of elements 1402*a* and 1402*b*, respectively, are discussed in connection with FIG. 18B.

Returning to FIG. 14, shoe 1400 includes a toe lasting board 1403 and a sock liner 1404. A portion of sock liner 1404 is removed in FIG. 14 to expose toe lasting board 1403. An upper (not shown) wraps around the underside of toe lasting board 1403. The upper is bonded to base plate 1401 and is thus situated between board 1403 and base plate 1401 in the forefoot region of shoe 1400. A carbon fiber reinforced polymer support plate, not shown in FIG. 14, may also be interposed between the upper and base plate 1401. Sock liner 1404 is contained within the interior of the upper and rests over actuator buttons 1408 and 1409 of extendable traction elements 1503 and 1504. Also visible in FIG. 14 are ring-shaped stop collars 1410 and 1411, the purpose of which is discussed below.

Figure 16A:
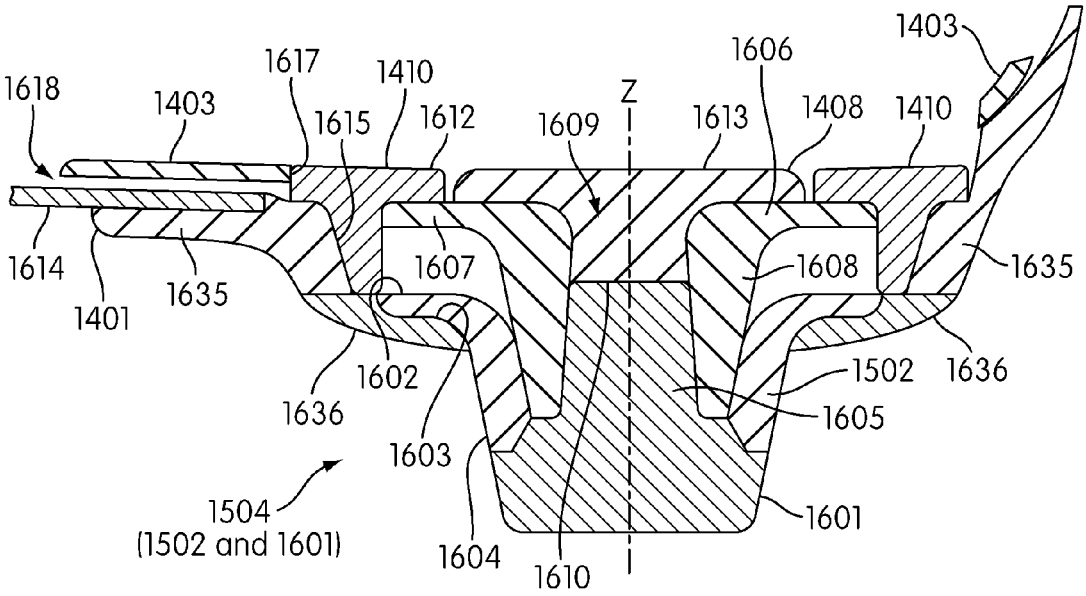
FIGS. 16A-16C are enlarged partial cross-sectional views corresponding to the location indicated in FIG. 14.
Figure 16B:
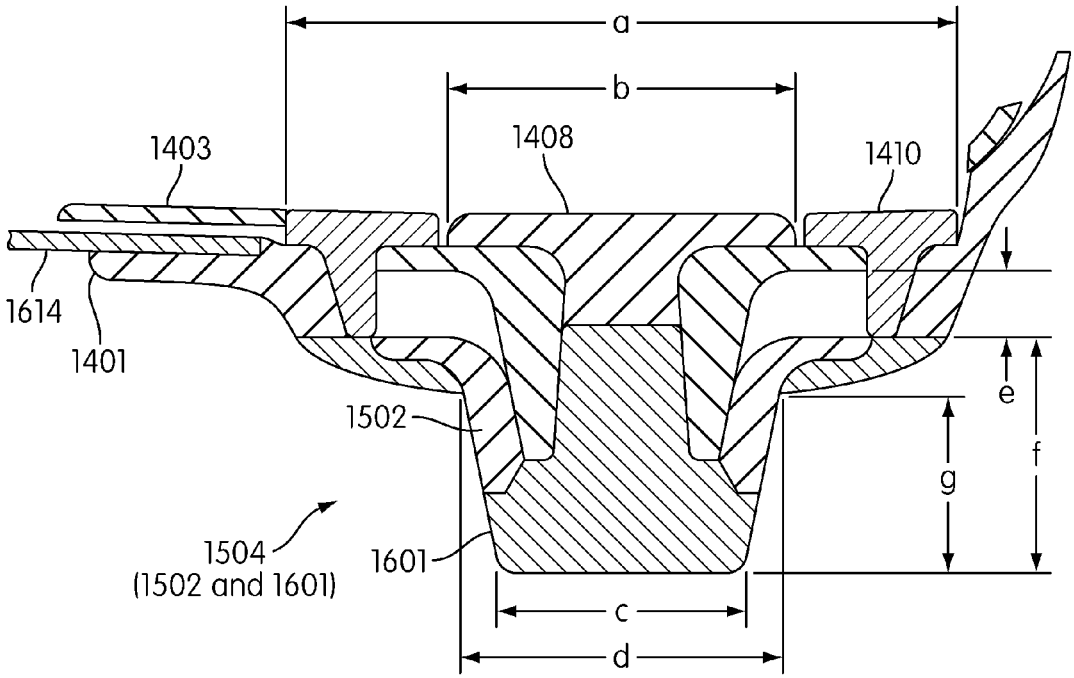
Figure 16C:
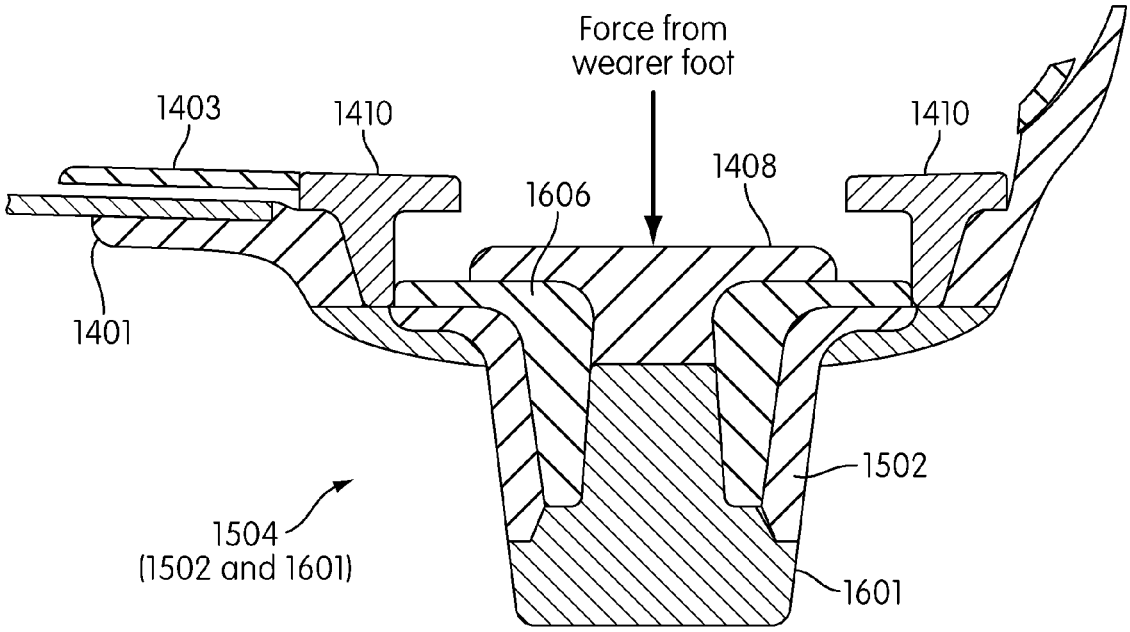

FIGS. 16A-16C are enlarged partial cross-sectional views of a portion of shoe 1400 taken from the location indicated in FIG. 14. In FIGS. 16A-16C, certain features have been omitted to avoid obscuring FIGS. 16A-16C with unnecessary details. For example, interior features of collar 1410 visible in FIG. 17 (slots 1701, the inner edge of rim 1612) are not shown in FIGS. 16A-16C.

FIGS. 16A-16C show additional details of extendable traction element 1504. Traction element 1503 is of similar construction and operates in a similar manner. Turning first to FIG. 16A, traction element 1504 includes elastic extender 1502 and an attached tip element 1601. Similar to previously-described embodiments, tip element 1602 may be formed from a material that is harder than a material used for extender 1502. Extender 1502 includes a rim 1602, the underside of which is bonded to a shelf 1603 formed in base plate 1401. Extender 1502 further includes a cylindrical portion 1604 that extends through an opening of base plate 1401 centered within shelf 1603.

Also shown in FIG. 16A is an actuator element 1606. Actuator 1606 includes an outwardly-extending flange 1607 and a downward projection 1608. Element 1606 further includes a through hole 1609. A raised portion 1605 of tip element 1601 fits within hole 1609 at a lower end. A stub 1610 of button 1408 fits within hole 1609 at an upper end. Similar to button 1124 and actuating member 1106 in the embodiment of FIGS. 11-13, button 1408 is freely rotatable relative to element 1606 about an axis Z but is constrained from translational motion relative to element 1606. A circular region 1613 on the upper surface of button 1408 is roughened or otherwise textured so as to reduce slippage relative to the underside of sock liner 1404.

As further shown in FIG. 16A, stopping collar 1410 rests within, and is bonded to the side walls of, a cavity 1615 formed in base plate 1401. Additional details of the placement of collar 1410 into cavity 1615 are discussed below in connection with FIG. 17. Stopping collar 1410 includes a rim 1612 that surrounds an opening through which button 1408 extends. An underside of rim 1612 forms a seat that acts as a stop to limit upward travel of actuator element 1608. As also discussed below in connection with FIG. 17, flange 1607 includes tabs that fit within corresponding grooves of collar 1410. This tab and groove arrangement permits actuator 1608 to move up and down within collar 1410 while preventing rotation of element 1608 relative to collar 1410.

FIG. 16A further shows a portion of a carbon-fiber reinforced support plate 1614 that is bonded to base plate 1401. In the embodiment of shoe 1400, a portion of support plate 1614 is exposed on the underside of shoe 1400. Also visible in FIG. 16A are portions of toe lasting board 1403. Material from an upper (not shown) would lie within space 1618 between toe last board 1403 and support plate 1614. An opening 1617 in board 1403 exposes collar 1410 and button 1408. Sock liner 1404, which is omitted from FIG. 16A for convenience, rests over board 1403 and covers collar 1410 and button 1408. In some embodiments, and as also seen in FIG. 16A, the top surfaces of collar 1410 and button 1408 are generally flush with the top surface of toe last board 1403 in the region adjacent to collar 1410. The top surfaces of collar 1411 and button 1409 are similarly flush with the top surface of last board 1403 in the region adjacent to collar 1411. This helps to provide a smooth surface facing the underside of sock liner 1404.

In certain embodiments, and as can be seen in FIG. 16A, base plate 1401 is formed from two distinct materials. A lower portion 1636 is a stud base that includes fixed traction elements 1402, stabilizers 1508 and 1509, and regions to which extendable traction elements 1503 and 1504 are attached. An upper portion 1635 is a connecting shot that forms the remainder of base plate 1401.

Exemplary dimensions for various features, as indicated in FIG. 16B, are provided in Table 1 below. Exemplary materials for components from FIG. 16A are provided in Table 2 below. Both tables merely provide examples according to some embodiments. Other embodiments include components fabricated from other materials and/or having different dimensions.

TABLE 1

| dimension | example value (mm) |
|---|---|
| a | 26 |
| b | 14 |
| c | 10 |
| d | 12 |
| e | 3 |
| f | 11 |
| g | 8 |

TABLE 2

| component | example material |
|---|---|
| actuator elements (e.g., 1606) | polyamide (NYLON) resin (e.g., DUPONT ZYTEL ST801 PA6/6) |
| buttons (e.g., 1408 and 1409) | high density polyethylene (HDPE) |
| base plate (1401) - lower portions contacting non-extendable traction elements and extenders (stud base 1636) | Thermoplastic Polyurethane Elastomer (Ester/Ether) (e.g., Bayer MaterialScience AG DESMOPAN DP 3660D) |
| base plate (1401) - upper portions (connecting shot 1635) | Thermoplastic Polyurethane Elastomer (Ester/Ether) (e.g., Bayer Material Science AG DESMOPAN DP 3695A) |
| tip elements (e.g., 1601), nonextendable traction elements (e.g., 1402) | Thermoplastic Polyurethane Elastomer (Ester/Ether) (e.g., Bayer Material Science AG DESMOPAN DP 3660D) |
| extenders (e.g., 1501, 1502) | TPU (e.g., BASF ELASTOLLAN S60AW or S70A) |
| stop collars (e.g., 1410, 1411) | nylon 6/6 (e.g., DUPONT ZYTEL ST801 PA 6/6) |

Extendable traction elements 1503 and 1504 operate in a manner similar to the embodiment of FIGS. 11-13. As shown in FIG. 16C, a downward force from a wearer's foot pushes button 1408 in an outward direction. This causes extender 1502 to elongate, thereby increasing the length of traction element 1504. In at least some embodiments, distance e (FIG. 16B) is approximately 3 mm, thereby allowing a 3 mm maximum extension of extender 1502 (and thus, of element 1504). In at least some such embodiments, extender 1502 is sized and is formed from a material that permits the maximum 3 mm elongation in response to a net downward force of approximately 400 Newtons.

Figure 17:
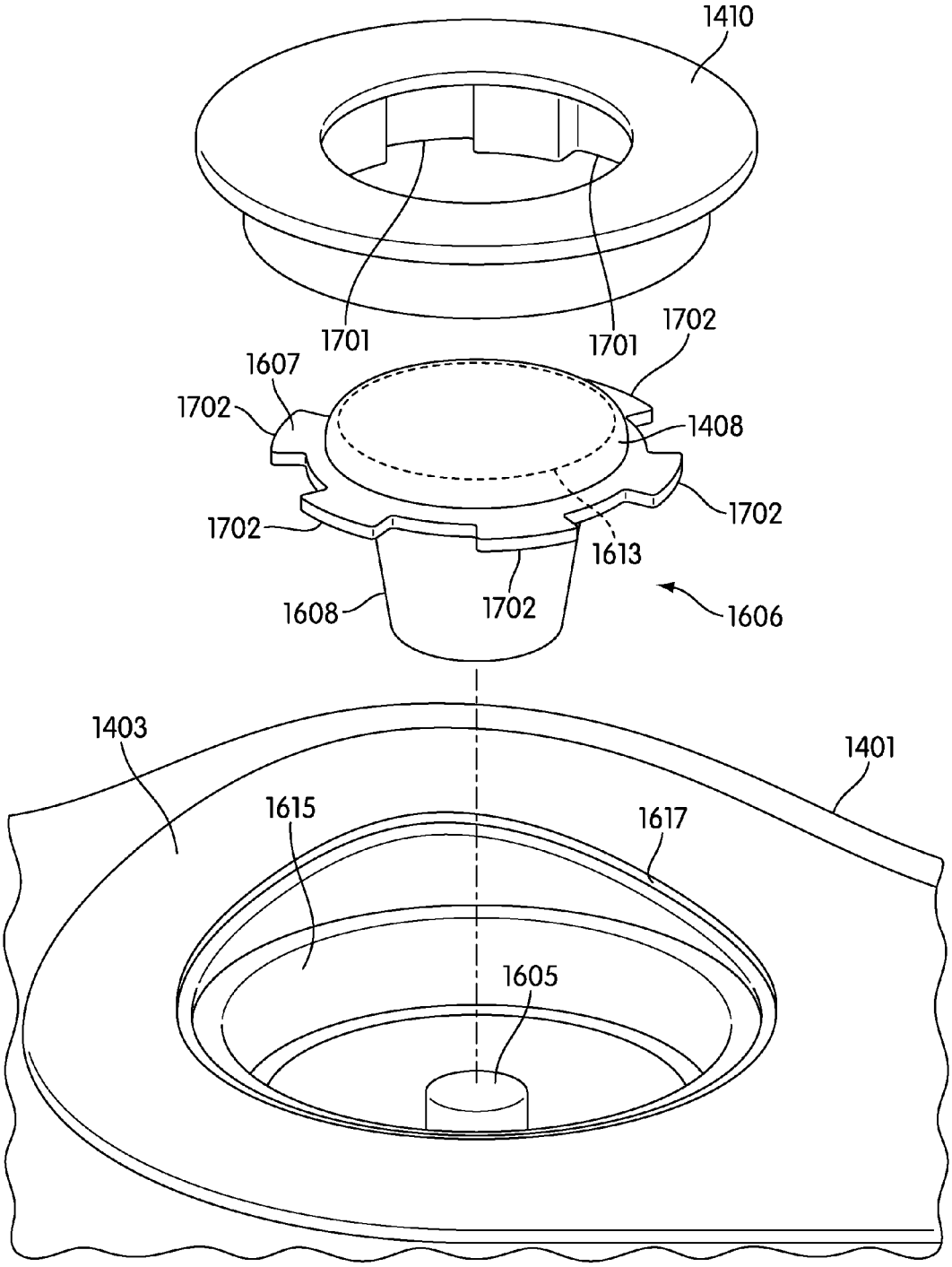
FIG. 17 is an enlarged partially exploded view showing selected components from the shoe of FIG. 14.

FIG. 17 is an enlarged partially exploded view showing stop collar 1410 and an actuator sub-assembly (actuator element 1606 and button 1408) removed from shoe 1400. The interior wall of collar 1410 includes a plurality of slots 1701. Flange 1607 of actuator element 1606 includes a plurality of tabs 1702. Each of tabs 1702 corresponds to (and moves vertically within) one of slots 1701. In some embodiments, the tops and sides of flange 1607 are polished to ease up and down movement within collar 1410. Similarly, the outer surfaces of stub 1610 (FIG. 16A), inner walls of hole 1609 contacted by stub 1610, the underside of button 1408 that contacts the upper surface of flange 1607, and the corresponding upper surface of flange 1607 contacting the underside of button 1408 may also be polished so as to facilitate free rotation of button 1408 relative to actuator element 1606.

In some embodiments, an outsole for shoe 1400 is manufactured by first molding a stud assembly that includes extendable traction elements 1503 and 1504, nonextendable traction elements 1402, outrigger stabilizer(s) for one or more of the nonextendable traction elements, and stud base 1636. As a first step of forming the stud assembly, the extenders are molded. After forming the extenders, stud base 1636, extendable traction element tips (tip 1601 and the tip of element 1503) and nonextendable traction elements are molded into place around the extenders. The formed stud assembly is then placed into a mold with carbon-fiber reinforcing plate 1614, and the remaining portion of base plate 1401 is molded with inlay connecting shot 1635.

In other embodiments, the stud assembly is formed by first forming the extendable traction element tip elements in a stand-alone mold. The molded tip elements are then placed into a second mold and stud base 1636 is molded in that second mold. After forming the stud base, extenders 1501 and 1502 are molded into place so as to connect the tip elements and stud base 1636. After forming the stud assembly in this manner, it is placed into a mold with reinforcing plate 1614 and the remainder of base plate 1401 is molded with inlay connecting shot 1635.

The upper for shoe 1400 is separately assembled with toe last board 1403. The upper assembly is then bonded to the outsole, with openings in toe last board 1403 aligned with the openings in base plate 1401 that correspond to extendable traction elements 1503 and 1504. Button 1408 is placed into the top of actuator 1606, with actuator 1606 then placed into collar 1410 from the underside of collar 1410 (see FIG. 17). The collar/actuator assembly is then placed into opening 1615 from the interior of the upper, with adhesive placed on surfaces of collar 1410 that will contact base plate 1401. Button 1409, collar 1411, and an actuator for traction element 1503 are assembled and installed in a similar manner.

In some embodiments, extension 1605 of tip 1601 (see FIG. 16A) and corresponding surfaces of hole 1609 may have mating threads. In such an embodiment, a tip for an extendable traction element may be attached by screwing the tip into place. Alternatively, a threaded extension 1605 of tip 1601 could engage with threads formed in extender 1502. In yet other embodiments, a threaded extension of tip 1601 could engage with threads formed in extender 1502 and with threads formed in hole 1609. In still other embodiments, the extension 1605 is metal and only the exposed bottom portion of the tip is formed from a polymer. In some embodiments having a threaded post as part of an extendable traction element, a stud tip is molded with an integrated threaded post. This threaded post is used as an attachment point for an actuator. That actuator may have a female thread molded into the actuator post. The actuator may be threaded onto the stud tip during assembly and the actuator housing may then be stock fit (cemented in place) over an actuator flange.

Figure 18A:
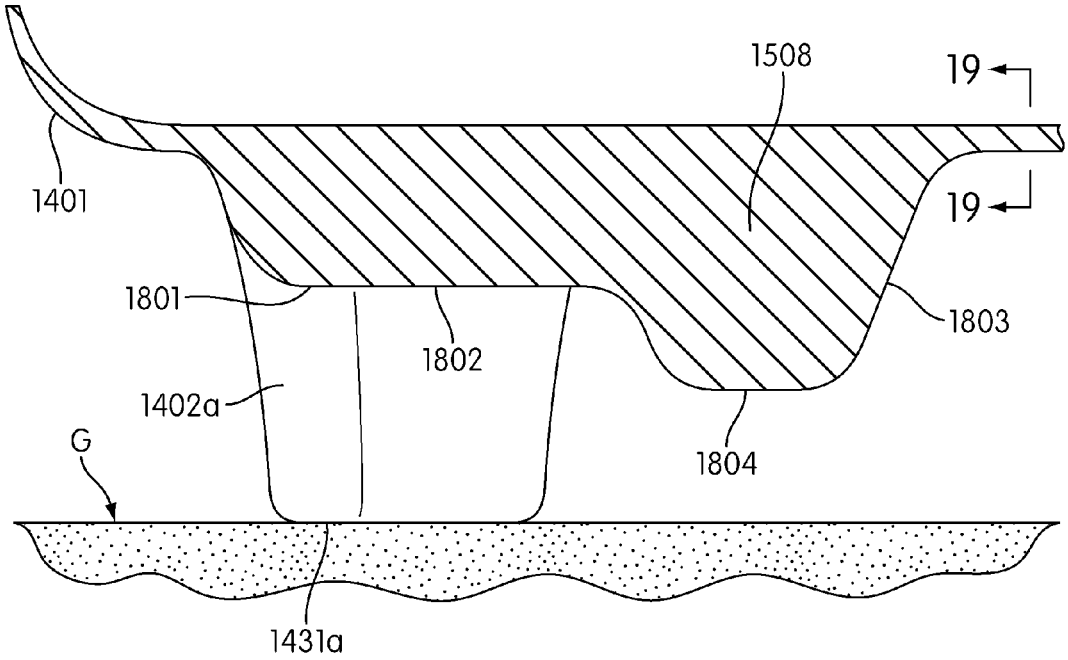
FIGS. 18A and 18B are cross-sectional views from the location indicated in FIG. 15.

FIG. 18A is a cross-sectional view, taken from the location indicated in FIG. 15, showing a portion of base plate 1401 that includes stabilizer 1508. The cross-sectional view of FIG. 18A is taken from a plane that bisects stabilizer 1508 along its length. Stabilizer 1509 is of similar construction and operates in a manner similar to that of stabilizer 1508. In FIG. 18A, shoe 1400 is resting on ground G and not currently subject to significant dynamic loading. For example, a wearer of shoe 1400 may be standing still and flat-footed on ground G.

In some embodiments, all of stabilizers 1508 and 1509 and all of traction elements 1402 (including elements 1402*a*-1402*d*) are formed from one material (e.g., DESMOPAN DP 3660D as indicated in Table 2) that is joined to other portions of base plate 1401 with a connecting shot of a different material (e.g., DESMOPAN DP 3695A as indicated in Table 2). In other embodiments, lower (ground-contacting) portions of the stabilizers and fixed traction elements are formed from a first material and upper portions of the stabilizers and fixed traction elements are formed from a different material (e.g., the same material used for the connecting shot). For simplicity, FIGS. 18A-19 do not attempt to show the presence of multiple materials. Similarly omitted from FIGS. 18A-19 are an upper, reinforcing plate 1614, toe last board 1403, sock liner 1404 and other internal elements of shoe 1400.

Stabilizer 1508 includes a base end 1801, a center portion 1802, and remote end 1803 having a ground-contacting region 1804. Unlike some of the embodiments previously described in connection with FIGS. 1-5, stabilizers 1508 and 1509 are integral to (and do not separate from) base plate 1401. For example, center portion 1802 is joined to the upper part of base plate 1401 along the entire length of portion 1802. However, stabilizers 1508 and 1509 deflect with base plate 1401 and help provide foot stabilization during various activities by a wearer of shoe 1400 that impose dynamic loading.

Figure 18B:
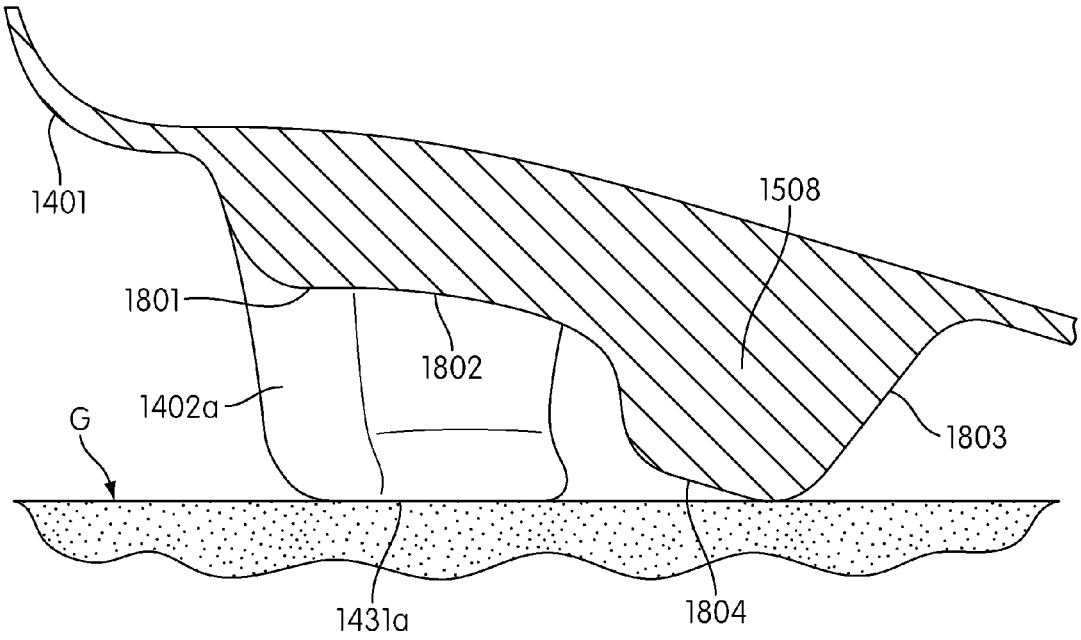

One example of such dynamic loading and resulting deformation is shown in FIG. 18B. FIG. 18B is a cross-sectional view taken from the same location as FIG. 18A, but during use of shoe 1400 in an athletic activity. In the example of FIG. 18B, the wearer of shoe 1400 has pushed outward to the lateral side of shoe 1400. This could occur, for example, if the wearer is quickly moving in a direction away from the lateral side of shoe 1400 (e.g., a cutting motion to the wearer's left). In response to these forces resulting from the wearer's activity, the fixed traction elements 1402 on the lateral edge of shoe 1400 deform slightly inward toward the medial side of shoe 1400. Stabilizer 1508 and adjoining portions of base plate 1401 may also deform somewhat. For example, center portion 1802 curves slightly with other portions of base plate 1401 located under the wearer foot. As a result of the deformation of elements 1402*a* and 1402*b* and/or of stabilizer 1508, regions 1804, 1431*a* and 1431*b* (see FIG. 15) are in contact with ground G. This provides a multi-point support that may help stabilize the wearer's foot during athletic activity.

Figure 19:
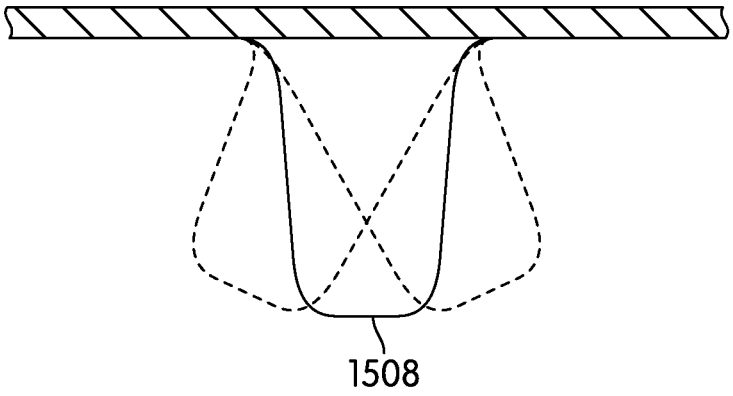
FIG. 19 is a cross-sectional view from the location indicated in FIG. 18.

FIG. 19 is a partial cross-sectional view taken from the location shown in FIG. 18A, and with traction elements 1402*a* and 1402*b* omitted. As indicated with broken lines, stabilizer 1508 can also deform slightly in directions transverse to the length of center portion 1802.

The foregoing description of embodiments has been presented for purposes of illustration and description. The foregoing description is not intended to be exhaustive or to limit embodiments to the precise form explicitly described or mentioned herein. Modifications and variations are possible in light of the above teachings or may be acquired from practice of various embodiments. The embodiments discussed herein were chosen and described in order to explain the principles and the nature of various embodiments and their practical application to enable one skilled in the art to make and use these and other embodiments with various modifications as are suited to the particular use contemplated. Any and all permutations of features from above-described embodiments are the within the scope of the invention. References in the claims to characteristics of a physical element relative to a wearer of claimed article, or relative to an activity performable while the claimed article is worn, do not require actual wearing of the article or performance of the referenced activity in order to satisfy the claim.

The invention claimed is:

1. An article of footwear, comprising:

an outsole base;

an elastic member having a first end fixed relative to the outsole base and a second end projecting away from the outsole base, the elastic member forming a portion of a traction element positioned for ground penetration when the article is used by a wearer of the article;

an actuating member located within the elastic member and positioned to transfer force from a foot of the wearer to the elastic member second end, the actuating member comprising a flange; and a stop collar fixed relative to the outsole base and having a rim, wherein the actuating member flange moves away from the stop collar rim in response to downward force on the actuating member that elongates the elastic member, and the stop collar rim is positioned to contact the actuating member flange and limit movement of the actuating member toward an interior region within an upper of the article when downward force on the actuating member is reduced.

2. The article of footwear of claim 1, wherein the stop collar includes a slot cooperating with a tab of the actuating member to prevent rotation of the actuating member relative to the stop collar.

3. The article of footwear of claim 2, wherein the slot cooperates with the tab to also prevent rotation of the actuating member relative to the elastic member.

4. The article of footwear of claim 1, wherein the elastic member is configured to elongate approximately 3 mm in response to a force of approximately 400 Newtons.

5. The article of footwear of claim 1, further comprising a tip element attached to the elastic member, wherein the tip element is positioned to be the most distal portion of the traction element relative to the outsole base, and the tip element is formed from a material having a hardness that is greater than a hardness of the elastic member.

6. The article of footwear of claim 5, wherein the tip element includes a first threaded portion and at least one of the elastic member and the actuating member includes a second threaded portion corresponding to and engaged with the first threaded portion.

7. The article of footwear of claim 5, wherein the tip element comprises a metal core located within the elastic member.

8. The article of footwear of claim 1, further comprising:

a second elastic member having a first end fixed relative to the outsole base and a second end projecting away from the outsole base, the second elastic member forming a portion of a second traction element positioned for ground penetration when the article is used by the wearer of the article; and a second actuating member located within the second elastic member and positioned to transfer force from a foot of the wearer to the second elastic member second end.

9. The article of footwear of claim 1, further comprising:

a second traction element attached to the outsole base, the second traction element extending outward from the outsole base and having a first portion positioned for ground contact; and a stabilizer having a base end connected to the second traction element, a center portion extending away from the second traction element across the outsole base and having a remote end displaced from the base end, the remote end having a second portion positioned for ground contact, and wherein the stabilizer is deflects with the outsole base, in response to forces resulting from activity of the wearer of the article, so as to place the first and second portions into ground contact.

10. The article of footwear of claim 9, wherein the stabilizer includes a projection on the remote end.

11. The article of footwear of claim 9, wherein the second traction element is located near an edge of the outsole base and the stabilizer extends toward an interior portion of the outsole base.

12. The article of footwear of claim 11, wherein the second traction element is near the lateral edge in a forefoot region of the outsole base.

13. An article of footwear, comprising:

an outsole base;

an elastic member having a first end fixed relative to the outsole base and a second end projecting away from the outsole base, the elastic member forming a portion of a traction element positioned for ground penetration when the article is used by a wearer of the article;

an actuating member located within the elastic member and positioned to transfer force from a foot of the wearer to the elastic member second end;

an interior region within an upper of the article and above the outsole base; and a button positioned on the actuating member between the actuating member and the interior region, wherein the button is constrained from translational movement relative to the actuating member but can rotate relative to the actuating member.

14. The article of footwear of claim 13, further comprising a stop collar fixed relative to the outsole base and having a rim, wherein the actuating member flange includes a flange that moves away from the stop collar rim in response to downward force on the actuating member that elongates the elastic member, the stop collar rim is positioned to contact the actuating member flange and limit movement of the actuating member toward the interior region when downward force on the actuating member is reduced, and the slot cooperates with the tab also prevent rotation of the actuating member relative to the elastic member.

15. The article of footwear of claim 13, further comprising a stop collar fixed relative to the outsole base and having a rim, wherein the actuating member flange includes a flange that moves away from the stop collar rim in response to downward force on the actuating member that elongates the elastic member, and the stop collar rim is positioned to contact the actuating member flange and limit movement of the actuating member toward the interior region when downward force on the actuating member is reduced.

16. An article of footwear, comprising:

a sole structure, the sole structure including an exposed underside and a stabilizer extending from the exposed underside in a first direction, and wherein the first direction is generally away from the exposed underside, the stabilizer includes a base end, a center portion and a remote end, the center portion is adjacent to the base end and to the remote end, the stabilizer also extends in a second direction, the second direction is generally parallel to the exposed underside, the base end, center portion and remote end are aligned in the second direction, the remote end has a maximum height in the first direction that is greater than a maximum height of the center portion, the remote end has a flat surface positioned for ground contact when the article is worn, the center portion has an exposed surface generally parallel to the flat surface, and a height of the exposed surface in the first direction is less than a height of the flat surface.

17. The article of footwear of claim 16, wherein the sole structure includes an associated traction element located adjacent to the base end, the traction element extends from the exposed underside in the first direction, the traction element has a maximum height in the first direction that is greater than the maximum height of the center portion, and a wall surface of the traction element is joined to a wall surface of the stabilizer.

18. The article of footwear of claim 17, wherein the sole structure includes an associated second traction element located adjacent to the base end, the second fraction element extends from the exposed underside in the first direction, the second traction element has a maximum height in the first direction that is greater than the maximum height of the center portion, and a wall surface of the second traction element is joined to another wall surface of the stabilizer.

19. The article of footwear of claim 16, wherein the remote end is a terminal end of the stabilizer.

20. The article of footwear of claim 19, wherein a length of the stabilizer in the second direction is greater than the maximum height of the remote end.

21. The article of footwear of claim 16, wherein a length of the exposed surface is greater than a length of the flat surface.

22. The article of footwear of claim 21, wherein the stabilizer has a substantially trapezoidal cross-section in a plane parallel to the first direction and orthogonal to the second direction.

23. The article of footwear of claim 21, wherein the stabilizer is located in a forefoot region of the sole structure.

24. The article of footwear of claim 21, wherein the second direction extends from an outer periphery of the sole structure toward a central region of the sole structure.

25. The article of footwear of claim 21, further comprising a second stabilizer having a shape similar to the shape of the stabilizer.

26. The article of footwear of claim 21, wherein the sole structure includes a base plate and the stabilizer is integral to the base plate.

27. An article of footwear, comprising:

a sole structure, the sole structure including an exposed underside and a stabilizer extending from the exposed underside in a first direction, and wherein the first direction is generally away from an interior region of an upper of the article positioned above the sole structure, the stabilizer includes a base end, a center portion and a remote end, the center portion is adjacent to the base end and to the remote end, the stabilizer also extends in a second direction, the second direction is generally parallel to the exposed underside, the base end, center portion and remote end are aligned in the second direction, the remote end has a maximum height in the first direction that is greater than a maximum height of the center portion, the stabilizer has a cross-section, in a plane parallel to the second and first directions, consisting essentially of a first trapezoid and a shorter second trapezoid, the first trapezoid extends the length of the stabilizer in the second direction and includes a partially-exposed side extending the second direction and coinciding with an exposed edge of the center portion, the second trapezoid corresponds to a portion of the remote end, includes an unexposed side extending in the second direction joined to an unexposed portion of the first trapezoid partially exposed side, and includes an exposed side extending at least partially in the second direction and positioned for ground contact when the article is worn.

28. The article of footwear of claim 27, wherein the sole structure includes an associated traction element located adjacent to the base end, the traction element extends from the exposed underside in the first direction, the traction element has a maximum height in the first direction that is greater than the maximum height of the center portion, and a wall surface of the traction element is joined to a wall surface of the stabilizer.

29. The article of footwear of claim 28, wherein the sole structure includes an associated second traction element located adjacent to the base end, the second fraction element extends from the exposed underside in the first direction, the second traction element has a maximum height in the first direction that is greater than the maximum height of the center portion, and a wall surface of the second traction element is joined to another wall surface of the stabilizer.

30. The article of footwear of claim 27, wherein each of the first and second trapezoids includes an additional exposed side forming a portion of an exposed end face of the remote end.

31. The article of footwear of claim 27, wherein a length of the exposed edge of the center portion is greater than a length of the exposed side of the second trapezoid.

32. The article of footwear of claim 27, wherein the stabilizer has a substantially trapezoidal cross-section in a plane parallel to the first direction and orthogonal to the second direction.

33. The article of footwear of claim 27, wherein the stabilizer is located in a forefoot region of the sole structure.

34. The article of footwear of claim 27, wherein the second direction extends from an outer periphery of the underside toward a central region of the underside.

35. The article of footwear of claim 27, further comprising a second stabilizer having a shape similar to the shape of the stabilizer.

36. The article of footwear of claim 27, wherein the sole structure includes a base plate and the stabilizer is integral to the base plate.

* * * * *